US005865876A

United States Patent [19]

Watkins et al.

[11] Patent Number: 5,865,876

[45] Date of Patent: Feb. 2, 1999

[54] MULTIPURPOSE LANCE

[75] Inventors: Richard R. Watkins, Merrillville; Kenneth M. Goodson, Hammond, both of Ind.; Nicholas M. Rymarchyk, Jr., Baden, Pa.

[73] Assignee: LTV Steel Company, Inc., N.J.

[21] Appl. No.: 767,994

[22] Filed: Dec. 13, 1996

Related U.S. Application Data

[63] Continuation-in-part of Ser. No. 486,339, Jun. 7, 1995, abandoned, and a continuation-in-part of Ser. No. 640,697, May 1, 1996, abandoned.

[51] Int. Cl.[6] ..... C21C 5/30

[52] U.S. Cl. ..... 75/548; 266/47; 266/225

[58] Field of Search ..... 266/225, 47, 265; 75/546, 548

[56] References Cited

U.S. PATENT DOCUMENTS

| | | |
|---|---|---|
| 2,817,584 | 12/1957 | Kootz et al. . |
| 3,320,053 | 5/1967 | Lehman . |
| 3,488,044 | 1/1970 | Shepherd . |
| 3,594,155 | 7/1971 | Ramachandran . |
| 3,620,455 | 11/1971 | Berry . |
| 3,653,877 | 4/1972 | Enya . |
| 3,700,429 | 10/1972 | Ramachandran . |
| 3,730,505 | 5/1973 | Ramacciotti et al. . |
| 3,754,892 | 8/1973 | Ando et al. . |
| 3,861,888 | 1/1975 | Heise et al. . |
| 3,932,172 | 1/1976 | Knuppel et al. . |
| 3,953,199 | 4/1976 | Michaelis . |
| 3,955,964 | 5/1976 | MacDonald et al. . |
| 4,004,920 | 1/1977 | Freuchan . |

(List continued on next page.)

FOREIGN PATENT DOCUMENTS

| | | |
|---|---|---|
| 876526 | 7/1971 | Canada . |
| 0059459 | 9/1982 | European Pat. Off. . |
| 0090452 | 3/1983 | European Pat. Off. . |
| 0423098 | 4/1991 | European Pat. Off. . |
| 2542014 | 2/1983 | France . |
| 2433217 | 1/1975 | Germany . |
| 3231867 | 8/1982 | Germany . |
| 51-12320 | 1/1976 | Japan . |
| 61-139616 | 6/1986 | Japan . |
| 6-25732 | 2/1994 | Japan . |
| 414312 | 6/1974 | Russian Federation . |

(List continued on next page.)

OTHER PUBLICATIONS

"Post Combustion in 240T Combined Blowing Converter", p. B–166, authored by Toshiyuki Soejima et al., presented at the 110th ISIJ Meeting, Oct. 1985, Lecture No. S1042, copyright date Dec. 1986.

"BOF Slopping Control", Steelmaking Proceedings, vol. 62, Dec. 1979, authored by R.G. Blossey, C.S. Kim and J.D. Shimkets, pp. 158–163.

"Investigation of the Effect on Post Combustion in LD Converter", Transactions ISU , vol. Dec. 25, 1985.

"Operating Results Using Post–Combustion Lances At The Bethlehem, PA, BOF Shop", authored by John J. Repasch et al., pp. 225–235, Dec. 1995 Steelmaking Conference Proceedings.

*Primary Examiner*—Scott Kastler

*Attorney, Agent, or Firm*—Watts, Hoffmann, Fisher & Henike Co., l. P.A.

[57] ABSTRACT

A steelmaking furnace is cleaned and maintained using a lance which includes an elongated lance body including at least one first nozzle opening proximal to an end that extends into the furnace and at least one other second nozzle opening spaced upwardly from the first nozzle opening. Structure defines at least one passageway extending through the body to the first nozzle opening and to the second nozzle opening. Gas supply means selectively introduces different gases into the passageway. The lance apparatus can be operated to emit either different gases or the same gas from the first and second nozzle openings at the same time. The gases emitted include an oxygen-containing gas and a gas that includes an inert gas.

44 Claims, 11 Drawing Sheets

U.S. PATENT DOCUMENTS

| | | |
|---|---|---|
| 4,081,270 | 3/1978 | Tichauer et al. . |
| 4,230,274 | 10/1980 | Rymarchyk et al. . |
| 4,270,949 | 6/1981 | Esposito et al. . |
| 4,322,033 | 3/1982 | Rymarchyk et al. . |
| 4,405,365 | 9/1983 | Robert . |
| 4,427,186 | 1/1984 | Buhrmann . |
| 4,434,005 | 2/1984 | Metz et al. . |
| 4,490,172 | 12/1984 | Moore et al. . |
| 4,533,124 | 8/1985 | Mercatoris . |
| 4,564,390 | 1/1986 | Gupta et al. . |
| 4,615,730 | 10/1986 | Tommaney . |
| 4,643,403 | 2/1987 | Buhrmann et al. . |
| 4,653,730 | 3/1987 | Wunsche et al. . |
| 4,746,103 | 5/1988 | Takashiba et al. . |
| 4,971,297 | 11/1990 | Henrion et al. . |
| 4,988,079 | 1/1991 | Takahashi et al. . |
| 5,088,696 | 2/1992 | Desaar . |
| 5,251,879 | 10/1993 | Floyd . |
| 5,298,053 | 3/1994 | Griffing . |
| 5,303,901 | 4/1994 | Bock et al. . |
| 5,377,960 | 1/1995 | Leczo et al. . |
| 5,417,739 | 5/1995 | Watkins et al. . |
| 5,635,130 | 6/1997 | Leczo et al. ..... 266/47 |

FOREIGN PATENT DOCUMENTS

| | | |
|---|---|---|
| 438702 | 1/1975 | Russian Federation . |
| 499315 | 4/1976 | Russian Federation . |
| 502950 | 4/1976 | Russian Federation . |
| 1395682 | 5/1988 | Russian Federation . |
| 1190137 | 4/1970 | United Kingdom . |

MULTIPURPOSE LANCE

CROSS REFERENCE TO RELATED APPLICATIONS

The present application is a continuation-in-part of pending U.S. patent application Ser. No. 08/486,339, filed Jun. 7, 1995 now abandoned and a continuation-in-part of U.S. patent application Ser. No. 08/640,697, filed May 1, 1996 now abandoned.

FIELD OF THE INVENTION

The present invention relates to cleaning and maintaining a steelmaking furnace and, in particular, to a multipurpose lance assembly and gas flow control apparatus for cleaning and maintaining a basic oxygen furnace.

BACKGROUND OF THE INVENTION

A basic oxygen furnace (hereinafter "BOF") used to make steel includes an outer steel shell and a refractory lining inside the outer steel shell. Most basic oxygen furnaces are equipped with two lances, only one of which can be in an operative position above the furnace at a given time. One of the two lances is an idle side auxiliary lance that is kept on standby outside the perimeter of the furnace. The other lance is a main oxygen blowing refining lance which, during the steelmaking process, is located in the furnace above the bath. In conventional BOF shops, a motorized lance transport and elevator system is used to manipulate the main and auxiliary lances.

Due to the violent agitation of the melt during refining of the molten metal into steel, a material commonly known as skull, a mixture of molten metal and oxides, is deposited on the working surface of the furnace and on the lances. The formation of skull at the cone of the BOF is undesirable because it restricts the ability to lower lances and charge scrap into the cone of the furnace.

One way the problem of skulling at the furnace cone has been addressed is to use a lance dedicated to deskulling. Oxygen gas is blown from the deskulling lance to melt the skull at the furnace cone by moving the lance vertically up and down near the location of the skull.

Due to factors including wear, high temperature and the combustion of high velocity oxygen gas in the furnace, the refractory walls deteriorate and must be repaired or replaced. One way to maintain the refractory walls of the furnace is through a process known as slag splashing in which a lance is used to blow an inert gas toward the slag layer. This causes the slag to be splashed upwardly onto the refractory walls and to coat portions of the refractory walls that have been worn. The slag cools on the refractory walls, effectively repairing worn portions of the walls. However, the slag splashing process may increase the problem of skull build-up at the cone of the furnace.

In view of the problems of skulling at the cone of the furnace and deterioration of the refractory walls, some BOF shops employ an idle-side deskulling lance and a refining lance. The deskulling lance is used to melt the skull from the furnace cone and the refining lance is used for refining the molten metal and for the slag splashing operation. This selection of lances is undesirable. The slag splashing tends to coat the refining lance with skull which requires removing the lance from the furnace. Thus, the furnace must be shut down frequently to replace the skulled refining lance.

Other BOF shops employ one lance for refining the molten metal and another lance for the slag splashing operation. When the furnace cone must be deskulled, one of the lances must be replaced with a deskulling lance, which is undesirable in that it takes time to replace lances.

SUMMARY OF THE INVENTION

The present invention relates to a slag splashing operation for maintaining a steelmaking furnace and a deskulling operation for cleaning the furnace, as well as a single lance apparatus capable of carrying out both operations. The present invention avoids the problems of conventional two lance carriage BOF shops. The equipment for carrying out the method of the present invention preferably includes an auxiliary idle side lance used in a two lance carriage BOF shop. The BOF shop also employs a typical oxygen blowing refining lance.

A first embodiment of the present invention is a "double circuit" lance assembly, which is defined herein as having two separate gas flow passageways isolated from mutual fluid communication that each lead to separate nozzles. This embodiment of the lance has one passageway leading to main nozzles and another passageway leading to auxiliary nozzles, both of which are disposed in the tip. The lance apparatus includes an array of control valves which are connectable to existing oxygen and nitrogen supply lines in a BOF shop and communicate with the lance passageways. Under regulation of the control valves, various combinations of oxygen and nitrogen gas may be selectively supplied to the main and auxiliary nozzles to conduct slag splashing and deskulling, as well as refining with post combustion capabilities in the event of an emergency.

In the double circuit lance embodiments of the present invention selective discharge means may be used for enabling an oxygen-containing gas and an inert gas to be selectively discharged from at least one main nozzle and auxiliary nozzle. The selective discharge means comprises a first inlet communicable with a first gas supply, a second inlet communicable with a second gas supply, a first outlet operatively connected to the main gas flow passage and a second outlet operatively connected to the auxiliary gas flow passage. A valve means selectively communicates the first and second inlets with the first and second outlets.

More specifically, the valve means comprises an array of two-position valves including a first valve connected to the first inlet and the first outlet. A second valve is connected to the first inlet and the second outlet. A third valve is connected to the second inlet and the first outlet. A fourth valve is connected to the second inlet and the second outlet. An apparatus for selectively opening and closing each of the first, second, third and fourth valves may also be provided.

A second preferred embodiment of the present invention is directed to a "single circuit" lance assembly which is connectable to oxygen and nitrogen supply lines of the BOF shop. As used herein, a "single circuit" lance is one in which a single common gas flow passageway leads to all of the nozzles of the lance. The common gas flow passageway terminates in one or more main nozzles provided at the lower end portion of the lance and one or more auxiliary nozzles spaced upwardly from the lower end portion of the lance. Gas supply means selectively introduces different gases into the passageway. The lance apparatus can be operated to emit either an oxygen-containing gas or an inert gas from the first and second nozzle openings at the same time.

In particular, in both the second and third embodiments of the invention the lance body extends along a longitudinal axis and each second nozzle extends along a gas flow path with respect to the longitudinal axis in the range of from about 60° to about 75°. According to any embodiment of the lance assembly disclosed herein, the angles of the first main nozzles may be adjusted as desired by using nozzle extensions. Each nozzle extension is preferably independently adjustable to project from its respective nozzle at one or more angles. Each first nozzle extends along a gas flow path at an angle with respect to the longitudinal axis in the range of from about 5° to about 20°. The nozzle extensions enable gas to be blown from the first nozzles at ranges of angles selected from the group consisting of: a) about 10° to about 20°, b) about 8° to about 15° and c) about 10° to about 14°.

In the preferred single circuit lance embodiment, one or more plug members is provided for preventing the flow of gas through the first nozzle opening. A portion of each first nozzle opening is defined by an interior threaded surface. Each of the plug members has an exterior threaded surface for engaging one of the interior threaded surfaces. Similarly, in any of the single or double circuit lance embodiments, each nozzle extension has an exterior threaded surface for engaging one of the interior threaded surfaces. The plugs and nozzle extensions may also be fastened to the lance using a latch device.

A third, preferred embodiment of the invention is directed to a double circuit lance assembly having main nozzles disposed at the lower end portion of the lance and auxiliary nozzles disposed at a location spaced upwardly from the lower end portion. One gas flow passageway leads to the main nozzles and another gas flow passageway leads to the auxiliary nozzles. These gas flow passageways are isolated from mutual fluid communication. Accordingly, the lance can blow an oxygen-containing gas and an inert gas from both the main and auxiliary nozzles to conduct slag splashing and deskulling.

One aspect of the third double circuit lance embodiment includes an elongated lance body having at least one first nozzle opening proximal to an end that extends into the furnace and at least one other second nozzle opening spaced upwardly from the first nozzle opening. A structure defines a first main gas flow passageway and a second auxiliary gas flow passageway extending through the body to the first nozzle opening and the second nozzle opening, respectively. The passageways are isolated from mutual fluid communication. A gas supply means selectively introduces different gases into the passageways. The lance apparatus can be operated to emit either different gases or the same gas from the first and second nozzle openings at the same time. The gases comprise inert and oxygen-containing gases.

The gas supply means comprises first valve means connected to an oxygen-containing gas source and to the first and second passageways. The first valve means is operable in one position to connect the oxygen gas source to both passageways and in another position to connect the oxygen gas source to a selected one of the passageways. A second valve means is connected to an gas source comprising an inert gas. The second valve means is operable in one position to connect the inert gas source to both passageways and in another position to connect the inert gas source to a selected one of the passageways.

One preferred aspect of the second and third embodiments of the invention is directed to a lance apparatus including an elongated lance body comprising a barrel and a tip portion disposed at a lower end of the barrel that extends into the furnace. At least one first nozzle opening is disposed in the tip portion and at least one other second nozzle opening is disposed in the barrel at a location spaced upwardly from the first nozzle opening. A structure defines at least one passageway extending through the body to the first nozzle opening and the second nozzle opening. Gas supply means selectively introduces different gases into the passageways. The lance apparatus can be operated to emit either different gases or the same gas from the first and second nozzle openings at the same time. The gases include inert and oxygen-containing gases.

One advantage of the lance assemblies of the present invention is that they do not suffer from significant skulling. Lance skulling is avoided by the present invention because a conventional lance is used for refining and the lance of the invention is used for furnace cleaning/maintenance. Conventionally, such as when one lance is used for both refining and slag splashing, the lance suffers from skulling since it is used frequently and not allowed to cool. Since the lance of the invention is not ordinarily used for refining, "self-cleaning" of the lance occurs when it is allowed to cool.

Moreover, since the refining lance is not required to be used for slag splashing in a BOF shop employing the invention, the refining lance does not suffer from excessive skulling. Therefore, furnace down time is minimized, because there is no need to replace skulled lances or to exchange a dedicated idle-side deskulling lance with a dedicated idle-side slag splashing lance.

Another advantage is that in the deskulling operation using the single circuit design, oxygen gas is only blown through the auxiliary nozzles, the main nozzles being plugged. During deskulling with the double circuit lance design, oxygen gas is blown from the auxiliary nozzles and an inert gas is blown from the main nozzles. Thus, in both the single and double circuit lance designs, due to blowing inert gas or plugging the main nozzles, the main nozzles are not clogged with skull and the furnace walls are not damaged.

In the refractory maintenance operation, an inert gas flows through both the main and auxiliary nozzles. The inert gas flowing through the auxiliary nozzles prevents them from becoming clogged with skull, while the inert gas flowing through the main nozzles effects the slag splashing operation. The angles of the main and auxiliary nozzles may be adjusted as desired to suit the combined slag splashing and deskulling operations.

The following describes methods of cleaning and maintaining a basic oxygen furnace, which are applicable, in particular, to the second and third preferred embodiments of the invention. One aspect of a method of operating a lance in a basic oxygen furnace includes moving the lance into the furnace along an axis of travel. Gas such as an inert gas is blown from the lance in a direction forming an angle of about 5° to about 20° with respect to the axis of travel. This gas is preferably blown from a lower end portion of the lance. Gas such as an oxygen-containing gas is blown from the lance in a direction forming an angle of from about 60° to about 75° with respect to the axis of travel. This gas is preferably blown from a location spaced upwardly from the lower end portion of the lance.

Another aspect of the method includes moving a lance along an axis of travel into the basic oxygen furnace until the end of the lance is positioned a desired distance from the bottom of the basic oxygen furnace. During a slag splashing operation, a gas comprising inert gas is blown onto slag so as to deposit the slag onto the walls of the basic oxygen furnace. This blowing step is carried out by discharging the inert gas from preferably the lower end portion of the lance along a flow path which forms an angle from about 5° to about 20° with respect to the axis of travel. During this slag splashing operation, an inert gas is preferably also blown from the second nozzles in both the single and double circuit lances.

The basic oxygen furnace is deskulled by blowing an oxygen-containing gas from preferably above the lower end portion of the lance onto skull deposits on the walls of the basic oxygen furnace. The deskulling step is carried out by discharging the oxygen-containing gas from the lance along a flow path which forms an angle of about 60° to about 75° with respect to the axis of travel.

In the case of the double circuit lance an inert gas is preferably blown from each first nozzle during deskulling. In the case of the single circuit lance, oxygen gas is prevented from flowing from each first nozzle during deskulling by inserting a plug member in each first nozzle.

Other embodiments of the invention are contemplated to provide particular features and structural variants of the basic elements. The specific embodiments referred to as well as possible variations and the various features and advantages of the invention will become better understood from the accompanying drawings and the detailed description that follows.

DETAILED DESCRIPTION OF PREFERRED EMBODIMENTS

Figure 2:
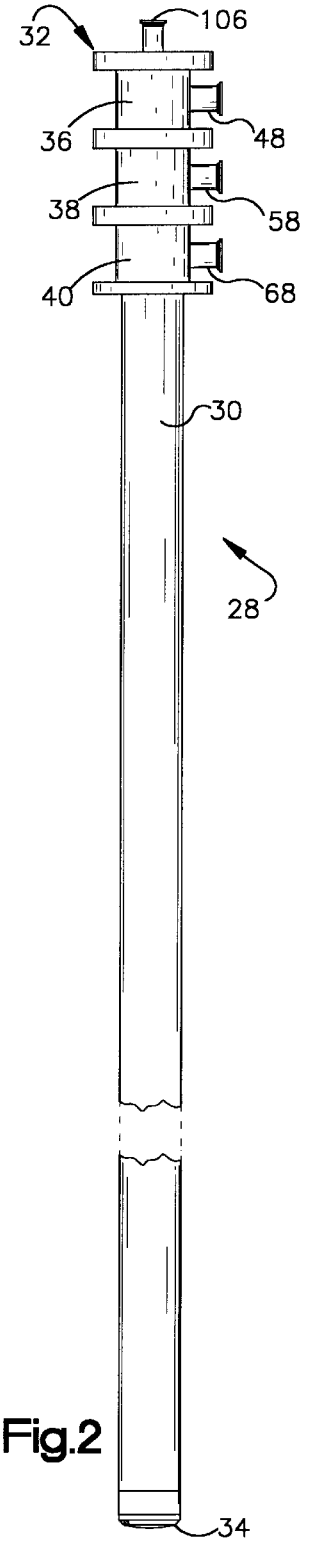
FIG. 2 is a side elevational view of a first embodiment of a lance constructed in accordance with the present invention in the form of a double circuit lance.
Figure 3:
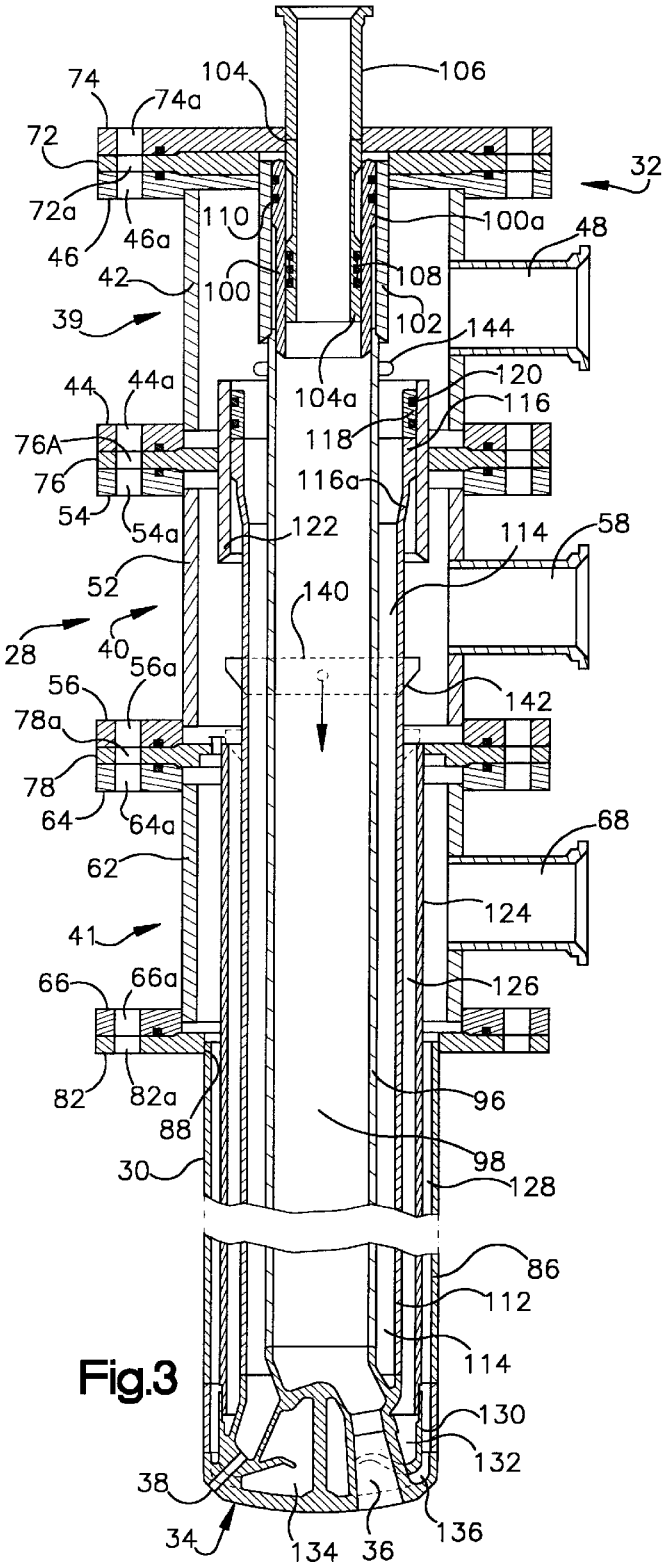
FIG. 3 is an enlarged, vertical cross-sectional view of the lance shown in FIG. 2.

Referring first to FIGS. 2 and 3 of the drawings, a double circuit lance of the first embodiment of the present invention is shown generally at 28. The lance includes an elongated barrel 30 having an upper end portion connected to a housing 32 and a lower end portion at which a tip 34 is disposed. The lance includes main nozzles 36 and auxiliary nozzles 38 which, in this particular embodiment, are disposed in the tip. The main and auxiliary nozzles are both capable of blowing either an inert gas or an oxygen-containing gas.

Figure 1A:
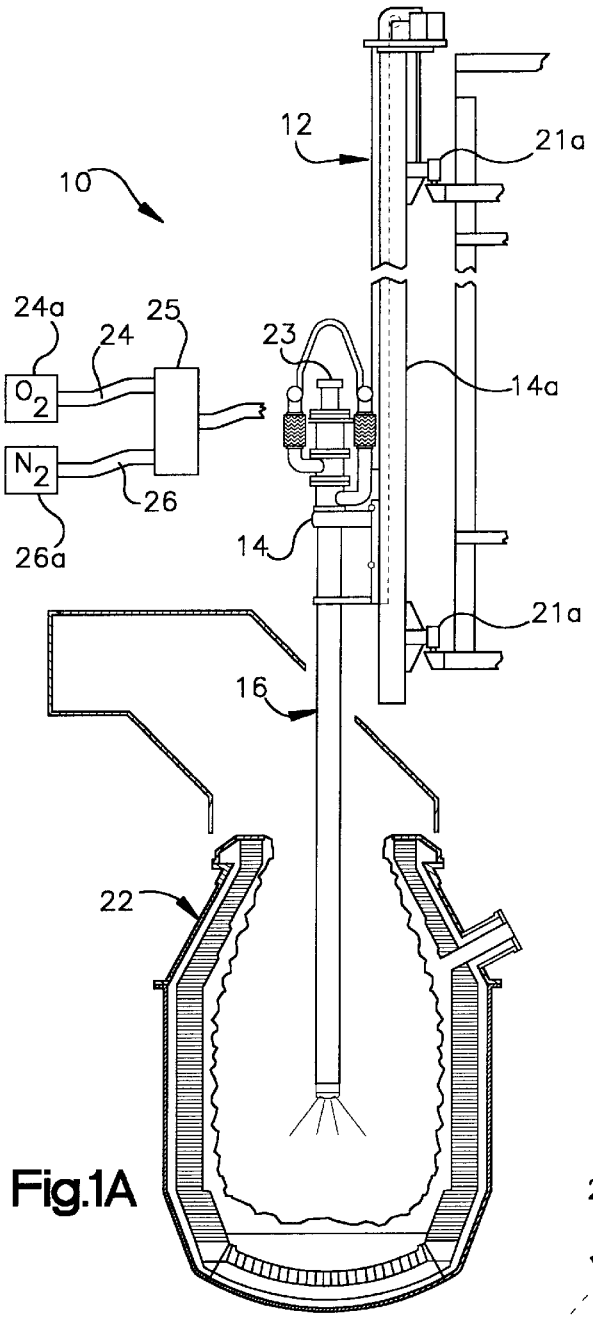
FIG. 1A is an elevational schematic view of a portion of a conventional BOF shop.

FIG. 1A shows a BOF steelmaking shop, generally designated by reference numeral 10. The shop comprises a lance transport and elevator system 12 having a first lance carriage 14 and a second lance carriage 18. The first lance carriage 14 supports a first lance 16 used for refining. The second lance carriage 18 supports a second auxiliary lance of the present invention, for example the lance 28, which is used for both deskulling and slag splashing. The lance carriages are pivoted in a conventional manner between alternate "operating" and "standby" positions with respect to the top of a BOF vessel 22. The lance transport and elevator system 12 includes winch and cable means (shown in phantom lines in FIG. 1A), which move each of the lance carriages 14 and 18 to lower and raise the lances into and from the BOF.

When in the operative position the lance gas inlet 23 of the appropriate one of the lances may be connected via a diverter valve 25 or similar gas flow control means to gas supply lines 24, 26. The gas supply lines 24, 26 in turn are respectively connected to sources 24*a*, 26*a* of a pressurized oxygen-containing gas and a pressurized inert gas such as nitrogen gas. The operating lance is also connected to unillustrated intake and return lines of a conventional recirculating coolant system.

As shown in the embodiment of FIG. 3, the housing 32 includes modular housing sections 39, 40 and 41. The, housing section 39 includes a metal cylindrical pipe 42 having a pair of annular plates 44 and 46 welded at each end. The plates 44 and 46 include a plurality of bolt holes 44*a*, 46*a* concentrically arranged about the pipe 42 to connect the housing section 39 to the housing section 40. An auxiliary gas inlet pipe 48 is laterally affixed to the wall of the pipe 42.

Similarly, the housing section 40 is formed by a metal pipe 52 having a pair of annular plates 54 and 56 welded at each end. A water coolant inlet pipe 58 is laterally affixed to the pipe 52. The housing section 41 includes a metal pipe 62 having a pair of annular plates 64 and 66 welded at each end.

The annular plates 54 and 56 of the housing section 40 include a plurality of bolt openings 54*a* and 56*a* circumferentially arranged about the pipe 52. The annular plates 64 and 66 of the housing section 41 include a plurality of bolt holes 64*a*, 66*a* circumferentially arranged about the pipe 62. A lateral coolant outlet pipe 68 is affixed to the pipe 62.

The plate 46 of the housing section 39 is affixed to a pair of annular plates 72 and 74 each having bolt holes 72*a* and 74*a* arranged to be in alignment with the bolt holes 46*a*. The annular plates 46, 72 and 74 are connected together using bolt assemblies. An annular plate 76 is sandwiched between the plates 44 and 54 and includes a plurality of bolt holes 76*a* in alignment with the bolt holes 44*a* and 54*a*. An annular plate 78 is interposed between the annular plates 56 and 64 and includes bolt holes 78*a* in alignment with the bolt holes 56*a* and 64*a*. The three plates are connected together using bolt assemblies. The annular plate 66 is affixed to an annular plate 82 that is welded to the barrel 30. The plate 82 includes concentrically arranged bolt holes 82*a* disposed in alignment with the bolt holes 66*a* for receiving bolt assemblies to affix the annular plate 66 to the plate 82. The barrel 30 preferably comprises an elongated exterior metal pipe 86 that is welded to an internal edge 88 of the annular plate 82.

The tip 34 includes at least one of the main nozzles 36 and at least one of the auxiliary nozzles 38. As used throughout this disclosure, the term "nozzle" means an opening leading to the exterior of the lance, tubular members inserted into such an opening and tubular members formed integrally with the lance that form such an opening.

Figure 4:
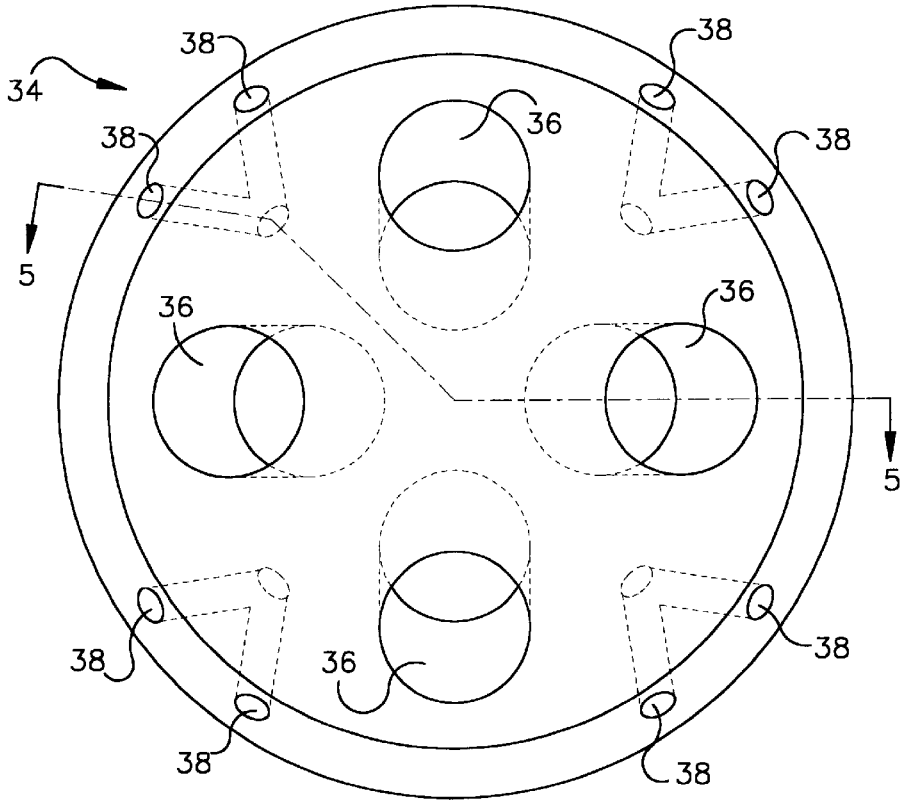
FIG. 4 is an enlarged end view of a lance tip constructed in accordance with the present invention.
Figure 5:
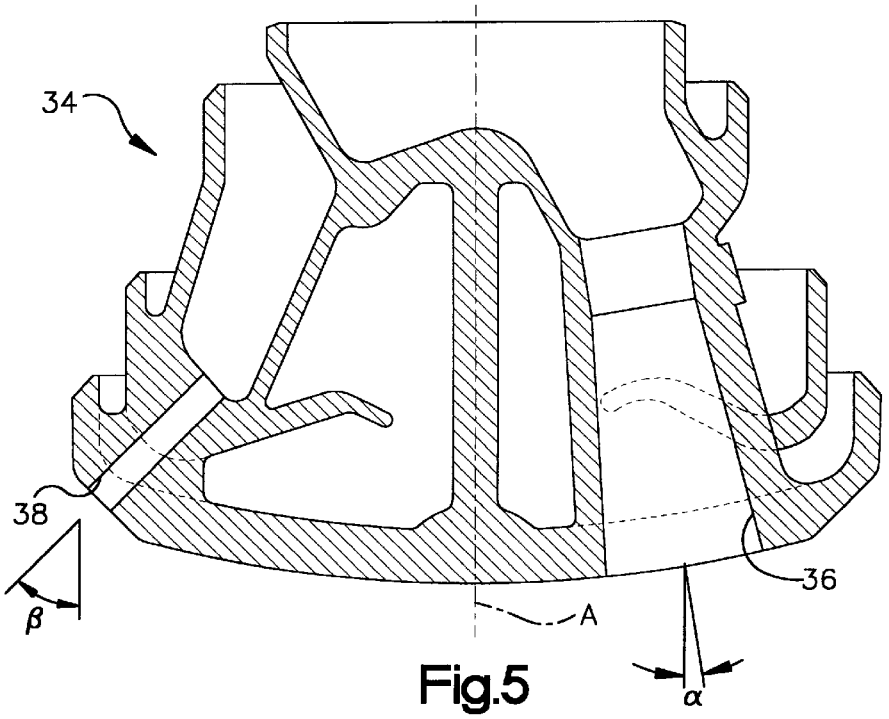
FIG. 5 is an elevational cross-sectional view of the tip of FIG. 4 taken along lines V—V thereof.

Turning to FIGS. 4 and 5, which show the tip of the lance 28, a plurality of main nozzles 36, most preferably four, are circumferentially spaced about a central axis "A" of the lance. The main nozzles preferably diverge outwardly from the central axis A at an angle $\alpha$ ranging from about 5° to about 20°. A plurality of the smaller diameter auxiliary nozzles 38, most preferably eight, are circumferentially spaced about the central axis A. The auxiliary nozzles 38 diverge from the central axis A at an angle $\beta$ in the range of from about 30° or greater.

Referring to FIG. 3, a centralmost pipe 96 extends substantially the entire length of the lance. The upper end of the pipe 96 is disposed adjacent the housing section 39 and its lower end is welded to the tip to define a main gas flow passageway 98 that communicates exclusively with the main nozzles 36. The upper end of the pipe 96 is welded to an internal sleeve 100 which is capable of relative movement within an outer sleeve 102. The outer sleeve 102 is welded to the annular plate 72. A third sleeve 104 is concentrically disposed within the internal sleeve 100. The sleeve 104 is welded to the annular plate 74 and extends upwardly therefrom to define a main lance gas inlet pipe 106. The sleeve 104 includes an enlarged end portion 104*a* fitted with at least one O-ring 108 which provides a slip seal between the sleeve 104 and the concentric sleeve 100. The sleeve 100 includes an enlarged end portion 100*a* having at least one O-ring 110 which provides a slip seal between the sleeve 100 and the outer sleeve 102.

A cylindrical conduit 112 is concentrically mounted about the pipe 96 to form an auxiliary gas flow passage 114 therebetween and extends from a first end 116 longitudinally to the tip where it is welded. The auxiliary gas flow passage 114 communicates exclusively with the auxiliary nozzles 38. The upper end 116 of the conduit 112 forms a tapered restriction 116*a* for directing the flow of auxiliary gas into the auxiliary gas flow passage 114. The upper end 116 of the conduit 112 is welded to a ring 118 having at least one externally mounted O-ring 120 that forms a slip joint with an outer sleeve 122. The sleeve 122 is welded to the internal edge of the annular plate 76. The mounting of the ring 118 separates the auxiliary gas flow from the coolant. The main gas flow passage 98 is isolated from fluid communication with the auxiliary gas flow passage 114.

A water coolant conduit 124 is concentrically arranged about a portion of the adjacent inner conduit 112 to form a coolant circulating system including a coolant inlet chamber 126 and an outer concentric coolant outlet chamber 128. The upper end of the coolant conduit 124 is mounted to the interior edge of the annular plate 78. The lower end of the coolant conduit 124 forms a slip joint with a sleeve 130 welded to the tip. It will be apparent throughout this disclosure that the auxiliary gas inlet pipe and the coolant inlet and outlet pipes of any of the lances can be positioned at any circumferential location of the lance.

The tip is also provided with a coolant inlet 132 in fluid communication with the lance coolant inlet chamber 126 and includes a passageway 134 therethrough in isolation from the nozzles. The coolant passageways 134 lead to a coolant outlet 136 in the tip to return coolant through the coolant outlet chamber 128.

The double circuit lance 28 preferably comprises means for enabling selective discharge of oxygen gas from the oxygen gas source 24*a* and nitrogen gas from the nitrogen gas source 26*a*. A preferred means for enabling selective gas discharge from the main and auxiliary nozzles of the double circuit lance 28 comprises a control valve array 138 (FIG. 6).

Figure 1B:
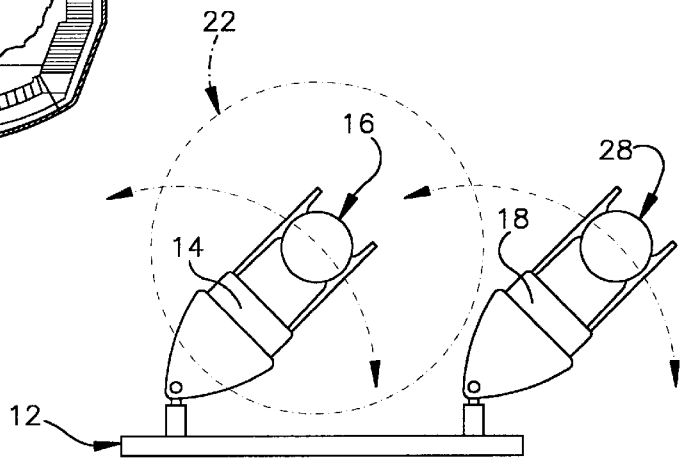
FIG. 1B is a diagrammatic top plan view of a portion of the lance transport and elevator system of the BOF shop of FIG. 1A.
Figure 6:
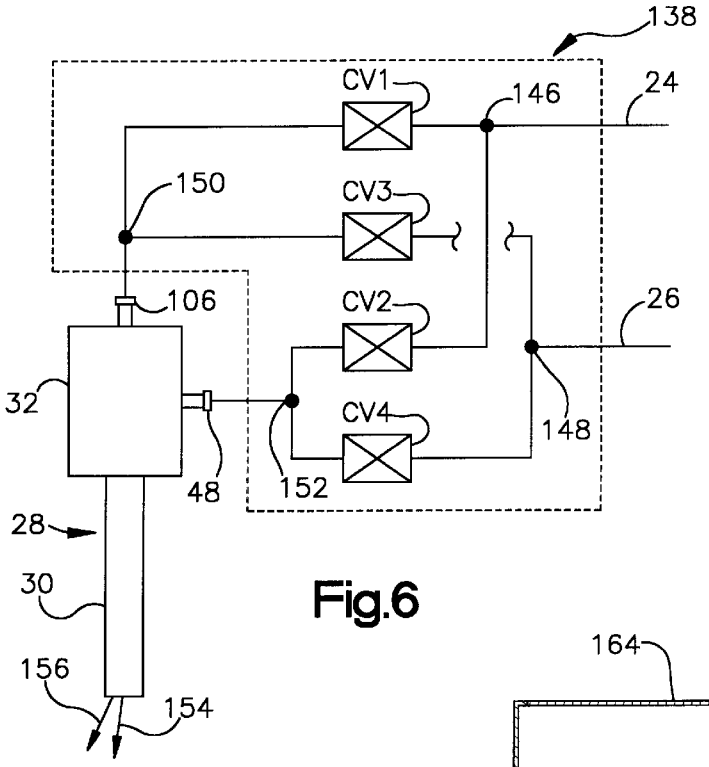
FIG. 6 is a schematic view of a lance control valve array of the present invention.

Turning to FIG. 6, the auxiliary lance gas inlet pipe 48 is connected to one outlet of the control valve array 138. The control valve array 138 may be used with both double circuit and single circuit lances of the present invention. Likewise, the main lance gas inlet pipe 106 is connected to another outlet of the control valve array. The control valve array is, in turn, connectable by separate inlets to the oxygen and nitrogen supply lines 24, 26 shown in FIGS. 1A and 1B. Through selective operation of a plurality of control valves within the control valve array it is possible to deliver pressurized oxygen and/or nitrogen gas to the auxiliary gas inlet pipe 48 and/or the main gas inlet pipe 106. As such, the double circuit lance assembly 28, under regulation of the control valve array, may perform both slag splashing and deskulling.

During operation of the lance, a coolant such as water is preferably introduced through the coolant inlet pipe 58, downwardly through the coolant inlet chamber 126, through the tip, through the coolant outlet chamber 128 and out through the coolant outlet pipe 68.

The conditions in the BOF normally cause thermal expansion of the exterior pipe 86 with respect to the internal conduits 96 and 112. The slip joint between the conduit 124 and the sleeve 130, as well as the slip joints created by the O-rings 120, 108 and 110, allow slippage between the conduits such that expansion can be accommodated internally without damage to the lance structure.

The lance assembly 28 also preferably includes an elastomeric annular shut off valve 140 affixed to the exterior of the conduit 112 to be responsive to failure or burning off of the tip. The elastomeric shut off valve 140 desirably includes a tapered leading edge portion 142 having a truncated cone configuration that is arranged to be seated against the upper end of the water coolant conduit 124 upon separation of the tip from the barrel 30, as shown in phantom in FIG. 3. This isolates the coolant water being introduced through the water coolant inlet pipe 58 to automatically cut off its supply to the coolant inlet chamber 126 with minimal coolant being directed into the molten bath. A plurality of pins 144 are preferably welded about the upper end portion of the innermost pipe 96. The pins 144 move with the pipe 96 upon separation of the tip 34 and are designed to wedge against the surface of the restriction 116 of the conduit 112 to prevent further movement between the parts.

Referring to FIG. 6, the control valve array 138 includes four independently operable, two-position valves identified as CV1, CV2, CV3 and CV4. Opening and closing of the several control valves may be independently effectuated manually, automatically (such as by computer control) or semi-automatically from a control panel via communication lines (not shown). The intake portion of the control valve array, comprises a first inlet 146, which may include a Y, T or similar coupling member, for connecting the control valves CV1 and CV2 to the oxygen supply line 24. Similarly, the control valve array further includes a second inlet 148, which may also include a Y, T or other appropriate coupling member, for connecting the control valves CV3 and CV4 to the nitrogen supply line 26.

A first outlet 150 includes a Y, T or like coupling member for connecting the control valves CV1 and CV3 to the main lance inlet pipe 106. A second outlet 152 includes a Y, T or other suitable coupling member for connecting the control valves CV2 and CV4 to the auxiliary gas inlet pipe 48.

The various modalities of the lance assembly 28 as determined by the control valves CV1, CV2, CV3 and CV4 are set forth in TABLE 1. Referring to FIG. 6, gas discharged from the main nozzles is represented by arrow 154, whereas gas discharged from the auxiliary nozzles is represented by arrow 156.

TABLE 1

| Lance Function | Main Nozzle Discharge Gas | Auxiliary Nozzle Discharge Gas | Control Valve Disposition |
|---|---|---|---|
| Oxygen Refining | $O_2$ | $N_2$ | CV1 (+) CV2 (−) CV3 (−) CV4 (+) |
| Post-combustion | $O_2$ | $O_2$ | CV1 (+) CV2 (+) CV3 (−) CV4 (−) |
| Slag Splashing | $N_2$ | $N_2$ | CV1 (−) CV2 (−) CV3 (+) CV4 (+) |
| Deskulling | $O_2$ and/or $N_2$ | $O_2$ | CV1 (±) CV2 (+) CV3 (±) CV4 (−) |

Where: + indicates an open control valve;

− indicates a closed control valve; and

± indicates a control valve that may be open or closed

Figure 7:
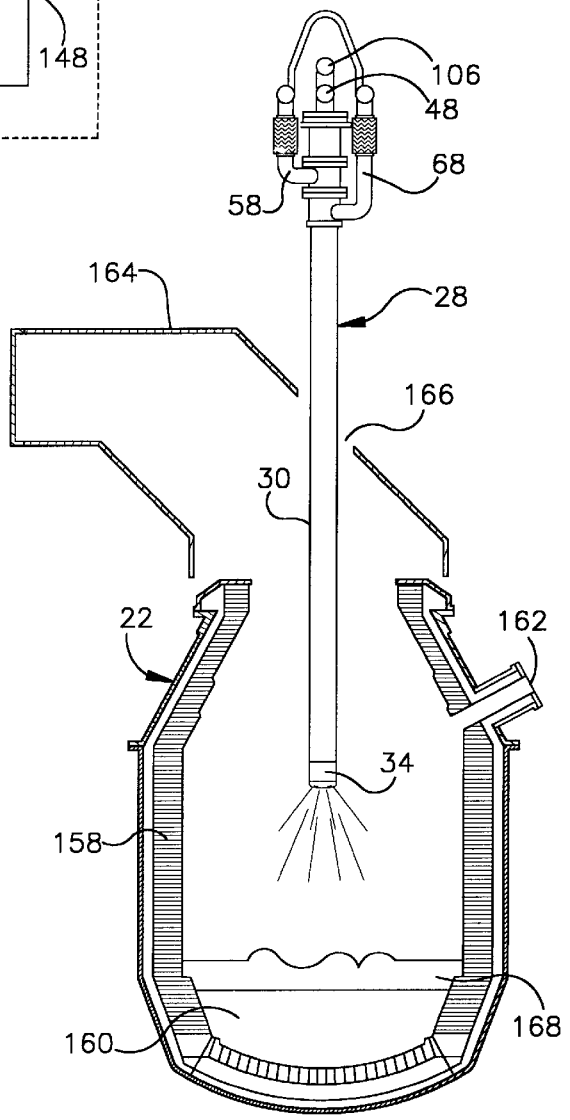
FIG. 7 is a side elevational view depicting the first embodiment of the lance during oxygen blowing (refining)
Figure 8:
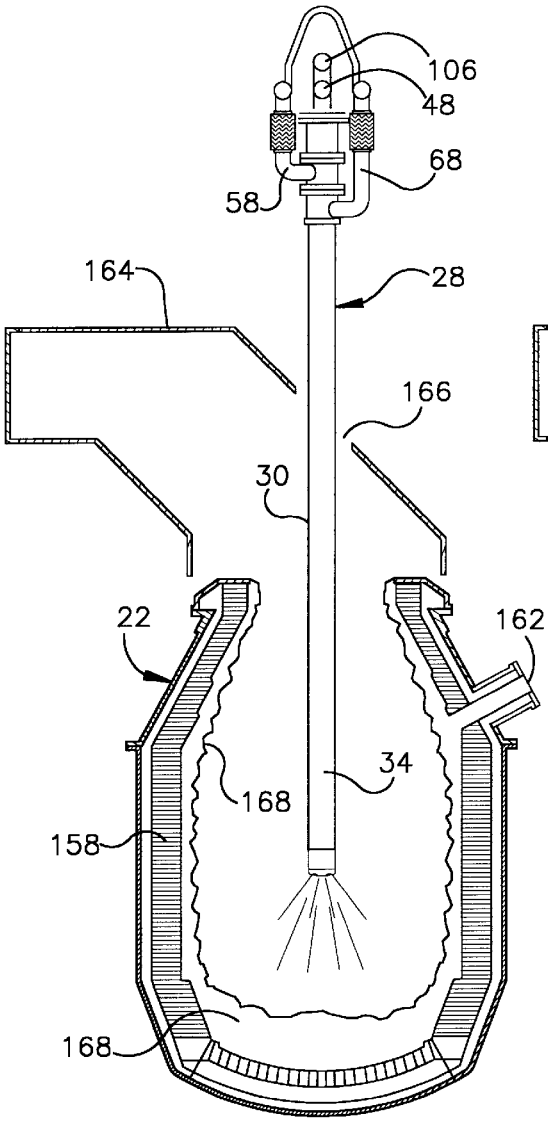
FIG. 8 is a view depicting the first embodiment of the lance during slag splashing.
Figure 9:
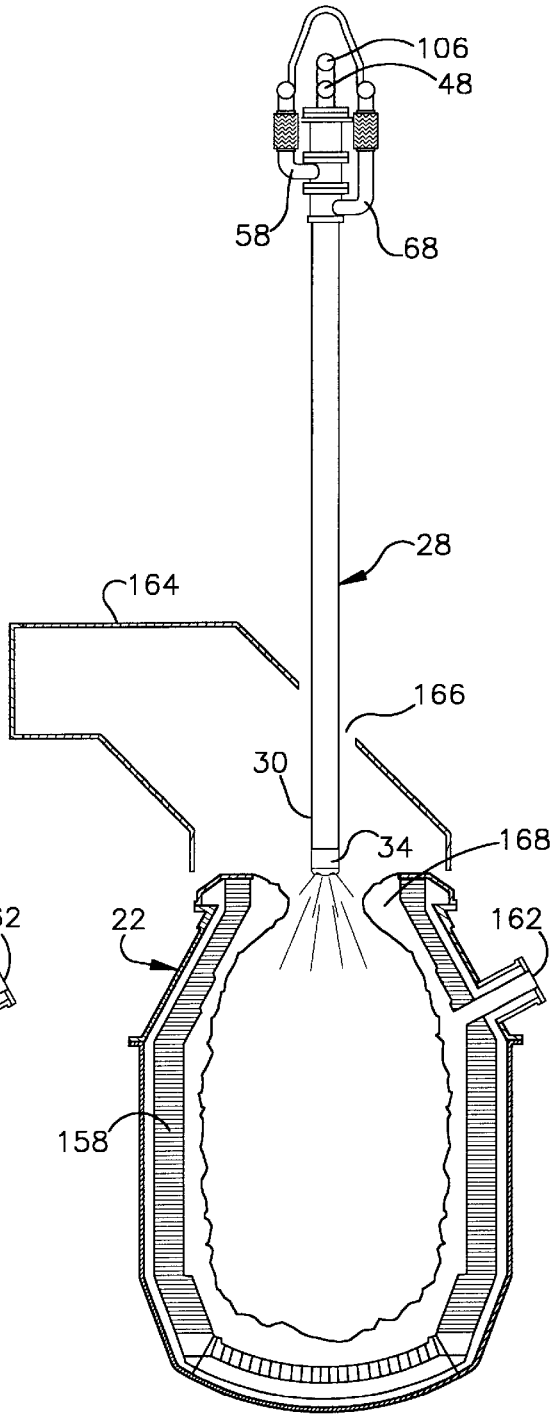
FIG. 9 is a view depicting the first embodiment of the lance during deskulling.

FIGS. 7, 8 and 9 refer to various phases of furnace cleaning, furnace maintenance and an emergency steelmaking procedure utilizing the double circuit lance 28 as regulated by the control valve array 138.

FIG. 7 illustrates the double circuit lance 28 as it would be disposed when conducting an emergency oxygen blowing refining operation such as when no other refining lance is available. The main and auxiliary nozzle angles are normally adapted for conducting the combined deskulling and slag splashing operations. Therefore, the main and auxiliary nozzle angles may need to be adjusted for refining.

As seen in FIG. 7, the BOF includes an inner lining of refractory material 158. The BOF holds a charge of contents that form a molten metal bath 160 and slag layer 168. At the completion of a heat, the metal bath is tapped for further processing from a tap hole 162 provided in the side wall of the vessel. The top of the vessel is enclosed by a hood 164 having a lance opening 166 to permit insertion and withdrawal of the lance 28 from the vessel 22.

Prior to the oxygen refining procedure shown in FIG. 7, the main lance gas inlet pipe 106 and the auxiliary gas inlet pipe 48 are first connected to the first and second control valve array outlets 150, 152 (FIG. 6). The control valve inlets 146, 148 in turn are connected to the oxygen supply line 24 and the nitrogen supply line 26. Likewise, the lance water coolant inlet pipe 58 and the lance water coolant outlet pipe 68 are connected to conventional unillustrated supply and exhaust lines of a circulating water coolant system.

The BOF is provided with a charge of material to be refined, as well any other additives to promote slag production or desired end-point chemistries in the refined product. Thereafter, the lance is lowered into the lance opening 166 of the hood 164 by an unillustrated lance transport and elevator system until the tip is spaced a preselected distance from the charge. At this point, the control valve array 138 (FIG. 6) is operated such that the control valves CV1 and CV4 are opened while the control valves CV2 and CV3 remain closed (see "oxygen refining" lance function of TABLE 1). So configured, the control valve array permits high-pressure oxygen gas to be injected from the main nozzles to commence combustion in the vessel 22 while a purge gas flow of nitrogen prevents clogging or contamination of the auxiliary nozzles. The molten metal bath is then refined into steel in the well known manner.

If additional oxygen is necessary during the emergency refining operation for post combustion, the control valve CV4 may be closed and CV2 may be opened whereby oxygen may be injected by both the auxiliary nozzles and the main nozzles (see "post-combustion" function of TABLE 1). The primary and auxiliary nozzle angles may need to be decreased from their normal deskulling orientations so as to be usable in the post combustion operation.

At the end of the heat, all of the control valves CV1–CV4 are closed, the lance 28 is withdrawn from the vessel 22 and the molten metal bath 160 is tapped through the tap hole 162 for further processing.

Turning to FIG. 8, after the molten metal bath has been tapped, the lance 28 is reinserted into the vessel. At this time, the control valves CV3 and CV4 are opened while the control valves CV1 and CV2 remain closed (see "slag splashing" function of TABLE 1). The main nozzle angles may be adjusted for the slag splashing operation from the angles used for refining. With only the control valves CV3 and CV4 being open, high-pressure nitrogen gas is blown from both the main and auxiliary nozzles. When the slag-splashing operation is complete, all of the control valves CV1–CV4 are again closed and the lance 28 is withdrawn from the vessel 22.

If slag deposits at the vessel mouth have become excessive, the operator of the BOF shop may proceed to the deskulling operation depicted in FIG. 9. The lance 28 is inserted into the vessel until its auxiliary nozzles are directed at the slag deposits 168 at the vessel mouth. The control valve CV2 is opened and the control valve CV4 remains closed. Simultaneously, a purge gas flow of nitrogen (for preventing closing or contamination of the main nozzles) may be blown through the main nozzles by opening one or both of the control valves CV1 and CV3 (see "deskulling" function of TABLE 1).

The oxygen blown by the auxiliary nozzles impinges upon and melts the build-up of the skull 168. Once sufficient skull has been removed from the cone, all of the control valves CV1–CV4 are closed and the lance is then withdrawn from the vessel.

Figure 10:
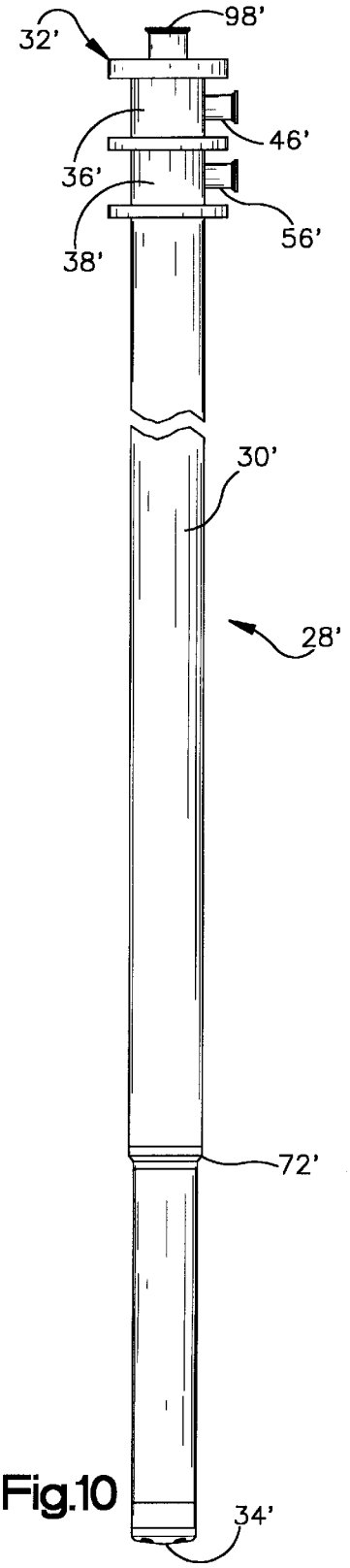
FIG. 10 is a side elevational view of a second preferred embodiment of a lance constructed in accordance with the present invention in the form of a single circuit lance.
Figure 11:
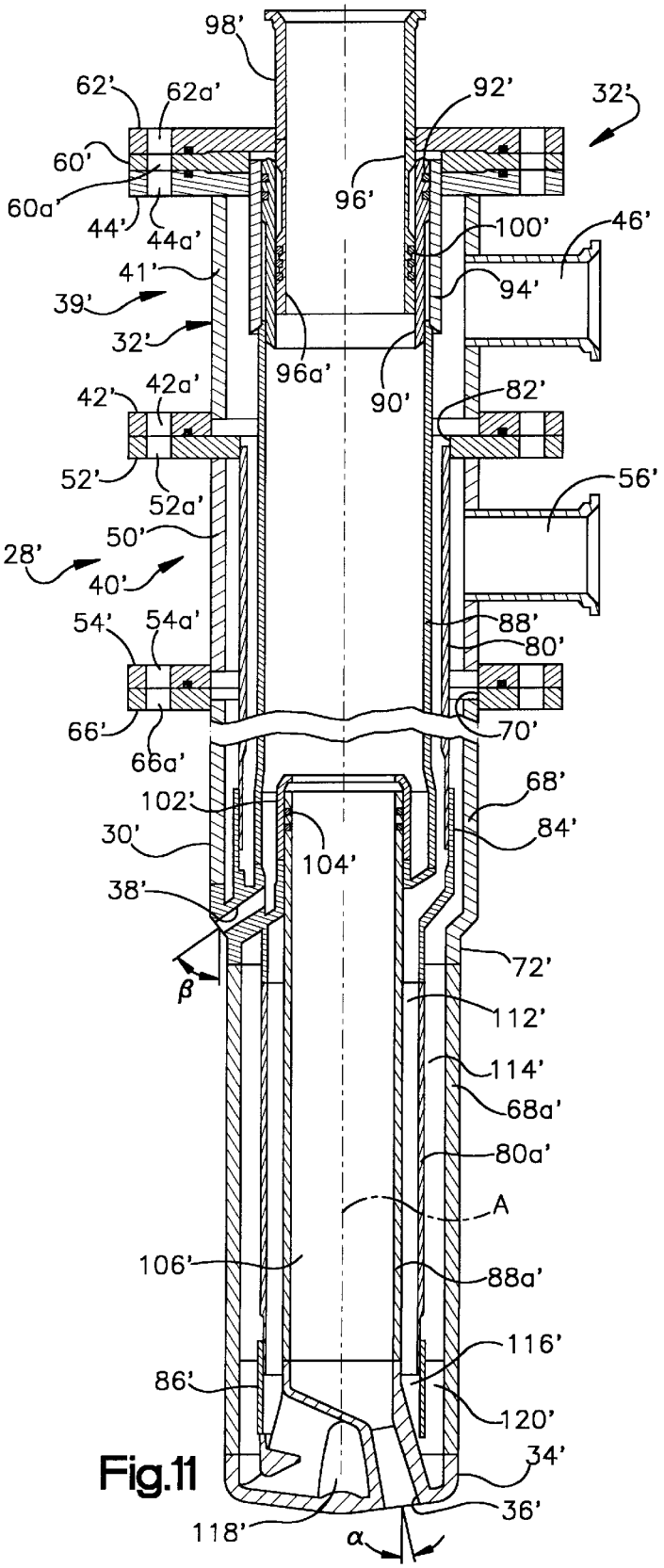
FIG. 11 is an enlarged, vertical cross-sectional view of the lance assembly shown in FIG. 10.

Referring to FIGS. 10 and 11, there is illustrated a second, preferred embodiment of the lance of the present invention in the form of a single circuit lance generally designated by reference numeral 28'. All of the reference numerals relating to this embodiment are designated by prime (') symbols for the sake of convenience. The lance 28' includes an elongated barrel 30' having an upper end portion connected to a housing 32' and a lower end portion at which a tip 34' is disposed. The lance includes main nozzles 36' and auxiliary nozzles 38'. The auxiliary nozzles 38' are spaced upwardly from the tip. The main and auxiliary nozzles are both capable of blowing an inert gas and an oxygen-containing gas.

The housing 32' includes modular housing sections 39' and 40'. The housing section 39' includes a metal cylindrical pipe 41' having a pair of annular plates 42' and 44' welded at each end. The plates 42' and 44' include a plurality of bolt holes 42*a*', 44*a*' concentrically arranged about the pipe 41'. A water coolant inlet pipe 46' is laterally affixed to the pipe 41'.

The housing section 40' is formed by a metal pipe 50' having a pair of annular plates 52' and 54' welded at each end. The annular plates 52' and 54' include a plurality of bolt openings 52*a*' and 54*a*' circumferentially arranged about the pipe 50'. A lateral coolant outlet pipe 56' is affixed to the pipe 50'.

The upper base plate 44' of the housing section 39' is affixed to a pair of annular plates 60' and 62' each having bolt holes 60*a*' and 62*a*' arranged in alignment with the bolt holes 44*a*'. The annular plates 44', 60' and 62' are connected together by bolt assemblies. The plates 42' and 52' include a plurality of bolt holes 42*a*' and 52*a*' and are connected together by bolt assemblies. An annular plate 66' is welded to the barrel 30'. The plate 66' includes concentrically arranged bolt holes 66*a*' disposed in alignment with the bolt holes 54*a*'. Bolt assemblies connect the annular plate 54' to the plate 66'.

The barrel 30' preferably comprises an upper exterior metal pipe 68' that is welded to an internal edge 70' of the annular plate 66' of the lower housing section 40'. The lower end of the pipe 68' is welded to an annular distributor member 72'. The distributor member 72' includes at least one or, more preferably, eight to ten of the auxiliary nozzles 38' (only one of which is shown) circumferentially spaced about a central axis "A" of the lance. The auxiliary nozzles 38' diverge radially outwardly from the central axis A at an angle β preferably in the range of from about 60° to about 75°.

The tip includes at least one or, more preferably, four main nozzles 36' (only one of which is shown) circumferentially spaced about the central axis A of the lance. The main nozzles preferably diverge radially outwardly with respect to the central axis A at an angle α ranging from about 5° to about 20°.

A lower exterior metal pipe 68*a*' is welded at its upper end to the distributor member. The lower end of the pipe 68*a*' is welded to the tip. Spaced inwardly of and concentric with the pipe 68' is an upper pipe 80'. The pipe 80' is welded at its upper end to the inner edge 82' of the annular plate 52' and at its lower end forms a slip joint with a sleeve 84' welded to the distributor member 72'. Likewise, spaced inwardly of and concentric with the lower pipe 68*a*'is an elongated pipe 80*a*'. The upper end of the pipe 80*a*' is welded to the distributor member 72', whereas the lower end thereof forms a slip joint with a sleeve 86' welded to the tip.

An elongated pipe 88' is spaced inwardly of and concentrically with the upper pipe 80'. At its upper end, the pipe 88' is welded to the lower end of an internal sleeve 90', the upper end of the sleeve 90' preferably being fitted with at least one O-ring 90'. The sleeve 90' is capable of relative movement within an outer sleeve 94'. The outer sleeve 94' is welded to the annular plate 60'. A third sleeve 96' is concentrically disposed within the internal sleeve 90'. The sleeve 96' is welded to an annular plate 62' and extends upwardly therefrom to define a lance gas inlet pipe 98'. The lance gas inlet pipe 98' may be connected, as desired, to the source of oxygen and/or nitrogen gas. The sleeve 96' includes an enlarged end portion 96*a*' fitted with at least one O-ring 100' which provides a slip seal between the sleeve 96' and the radially outer sleeve 90'. In addition, the O-ring 90' of the sleeve 90' provides a slip seal between the sleeve 90' and the outer sleeve 94'.

The lower end of the pipe 88' is outwardly flared and welded to the distributor member 72'. An upwardly extending sleeve 102' is welded to the distributor member 72'. Interiorly concentric with the lower pipe 80*a*' is a lower pipe 88*a*', the lower end of which is welded to the tip. The upper end of the pipe 88*a*' is fitted with at least one O-ring 104' which provides a sliding seal between the pipe 88*a*' and the sleeve 102'. A common gas flow passage 106' is in fluid communication with the gas inlet pipe 98' and provides both the main and auxiliary nozzles with a flow of nitrogen and oxygen gas supplied to the gas inlet pipe 98'.

The spaces between the pipes define a coolant inlet chamber 112' and a coolant outlet chamber 114'. The tip is also provided with a coolant inlet 116' in fluid communication with the coolant inlet chamber 112' and includes a passageway 118' therethrough, which is isolated from the nozzles. An outlet passage 120' is formed in fluid communication with the passageway 118' to return coolant through the coolant outlet chamber 114'.

Coolant such as water is preferably introduced during all stages of operation of the lance through the coolant inlet pipe 46', downwardly through the coolant inlet chamber 112', through the tip, through the coolant outlet chamber 114' and out the coolant outlet pipe 56'.

The conditions in the BOF normally cause thermal expansion of the exterior pipes 68' and 68*a*' with respect to the several conduits situated internally thereof. The numerous slip joints and O-ring seals discussed above allow slippage between the conduits such that expansion can be accommodated internally without damage to the lance structure.

A diverter valve enables selective discharge of both oxygen gas from oxygen gas source 24*a* (FIG. 1A) and nitrogen gas from nitrogen gas source 26*a* to the main gas inlet pipe 98'.

Figure 12A:
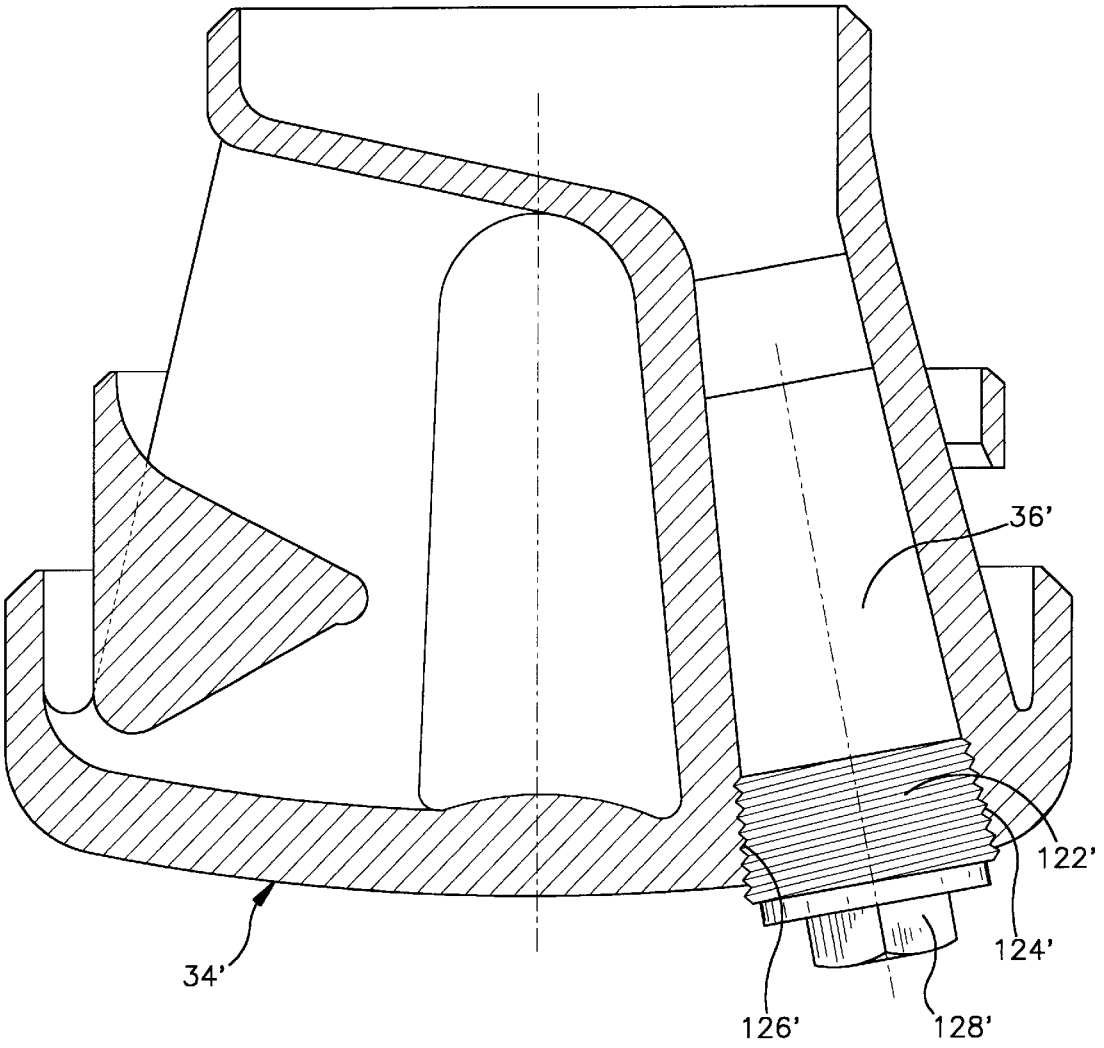
FIG. 12A is an enlarged elevational cross-sectional view of a tip of the lance of the second embodiment showing a threaded plug obstructing a main nozzle of the tip.

Turning to FIG. 12A, a tip 34' comprises removable plug members 122', one of which is shown disposed within a main nozzle 36' for selectively preventing gas flow through the main nozzles. Although the removable plugs are shown only in association with the main nozzles, it will be understood that they may be likewise inserted within the auxiliary nozzles to selectively prevent gas flow therethrough. The plugs 122' correspond in number and dimensions to the nozzles.

According to a preferred construction, the main nozzles and the plugs are provided with fasteners for releasably securing the plugs. Such fasteners may comprise, for instance, external threads 124' provided about the circumference of the plugs which is adapted to matingly engage with internal threads 126' provided along a portion of the lengths of the main nozzles. To facilitate insertion within the main nozzles, the plugs 122' are desirably formed with a recess or projection 128', e.g., a socket, that can be turned by a simple turning tool such as a wrench. The main nozzles and the plugs 122' may taper outwardly in the direction of gas flow to facilitate removal of the plugs.

Figure 12B:
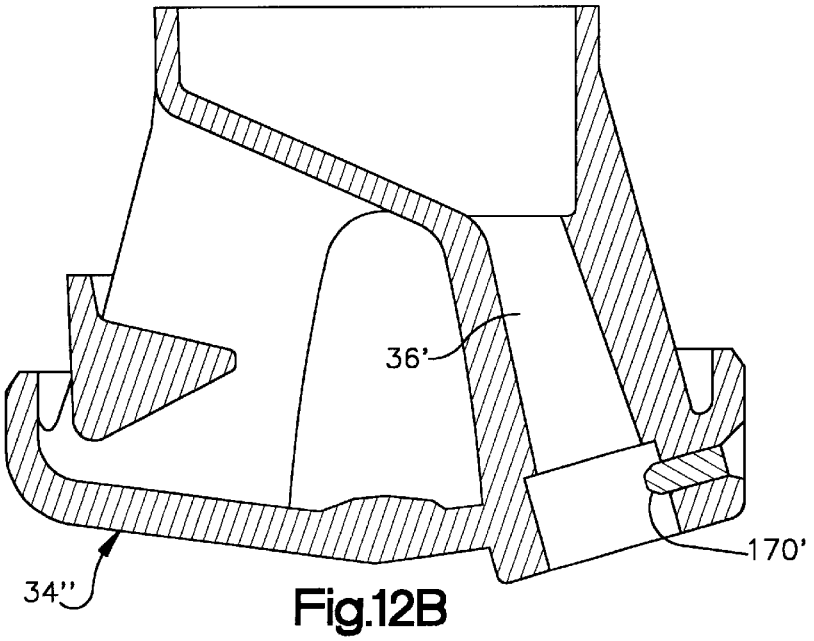
FIG. 12B is an enlarged elevational cross-sectional view of another tip of the lance of the second embodiment.
Figure 12C:
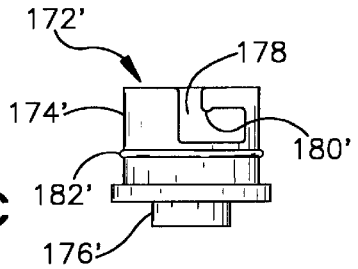
FIG. 12C is an enlarged elevational view of a removable plug for selectively obstructing a main nozzle of the tip of FIG. 12B.
Figure 12D:
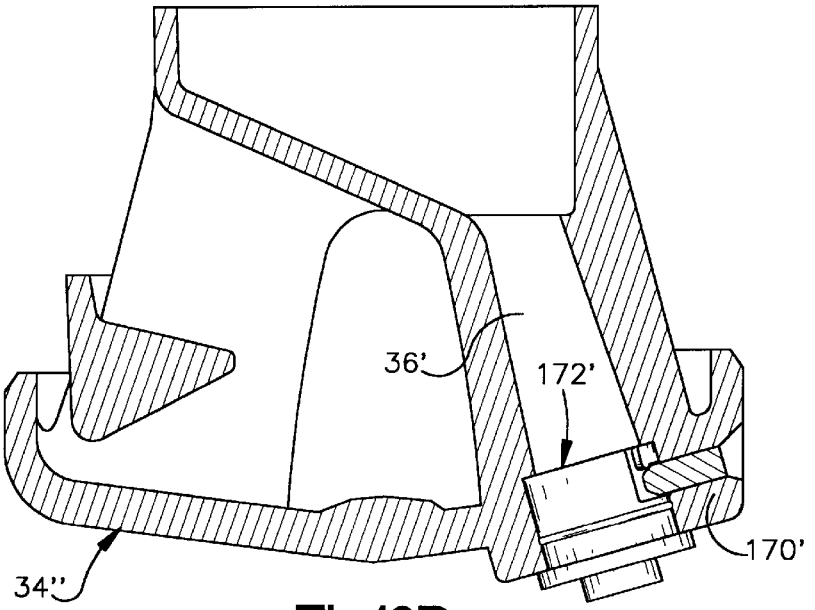
FIG. 12D is an enlarged, elevational, partial cross-sectional view of the removable plug obstructing a main nozzle of the tip.

FIG. 12B shows another form of tip 34" adapted to releasably receive plugs of an even more preferable construction. The main nozzles of the tip 34" preferably include latch means 170' in the form of at least one pin protruding inwardly of each of the nozzles. The latch pin 170' is adapted to releasably engage plugs 172' shown in FIG. 12C. More particularly, the plugs have a body portion 174' and a head portion 176'. The body portion 174' preferably includes at least one recessed, preferably generally L-shaped keyway or slot 178' corresponding in number and radial spacing to the latch pin. Each slot 178' further preferably includes a lip or ridge 180' for positively retaining the plugs 172' in engagement with the latch pin during operation of the lance assembly 28'.

To connect one of the plugs 172' in a main nozzle, the body portion 174' of the plugs is aligned with the latch pin 170' such that the latch pin is received by a first leg portion of the slot 178'. The plug is then pressed into the main nozzle to a point where it can be inserted no further. Thereafter, the plug is rotated through an angle of generally about 90° or less whereby the latch pin passes into a laterally extending second leg of the slot 178' until the ridge 180' fully passes the latch pin. The plugs 172' are then released. The plugs 172' remains in position in the main nozzle due to their weight, the pressure of gas exerted against them during operation of the lance, and the mechanical interference between the latch pin and the ridge 180'. To remove the plugs 172' the insertion procedure is simply reversed.

To minimize gas leakage through the main nozzles during lance operation the body portions of the plugs are also preferably provided with an unillustrated annular slot sized to receive an O-ring or similar sealing means 182'. To facilitate insertion of the plugs, the head portions of the plugs are desirably formed with a recess or projection that is suitable for turning by a simple turning tool such as a wrench.

It will be understood that the relative dispositions of the latch pin and engagement slots may be reversed. That is, the plugs 172' may carry one or more outwardly projecting latches similar to the latch pin 170' which engage correspondingly arranged recessed slots similar to the slots 178' in the interior walls of the main nozzles 78'. Again, although not illustrated, similar cooperating releasable stop structures may be provided in the auxiliary nozzles.

Figure 15:
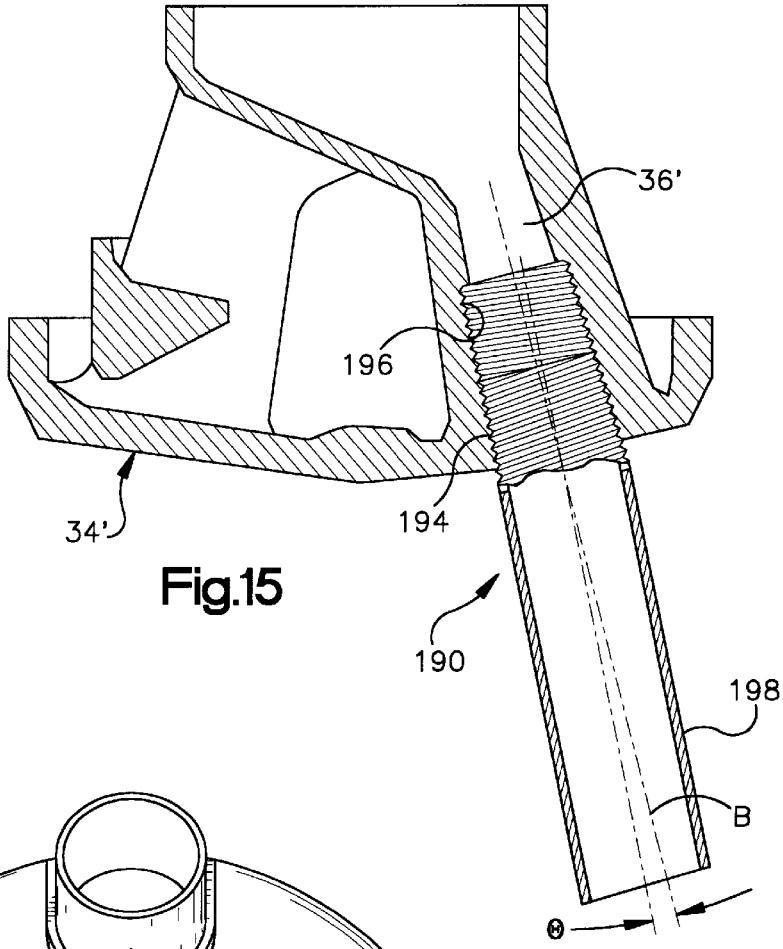
FIG. 15 is an elevational cross-sectional view of a nozzle extension inserted into a main nozzle of a tip.
Figure 16:
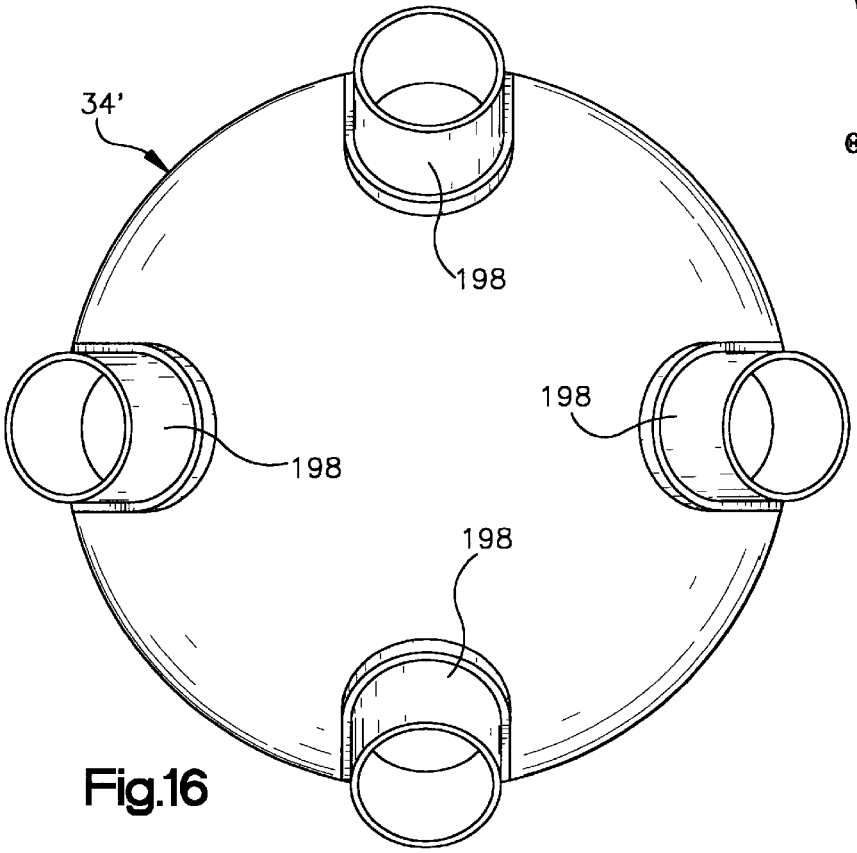
FIG. 16 is a bottom plan view of the tip of FIG. 16.

As illustrated in FIGS. 15 and 16, the present invention preferably comprises nozzle extensions 190 for selectively adjusting the flow characteristics of gas injected by the main and/or auxiliary nozzles. The following discussion of the nozzle extensions 190 shall apply equally with respect to their use in either the main or auxiliary nozzles.

The nozzle extensions 190 are tubular and may range from several inches to more than a foot in length. The main nozzles and the nozzle extensions are thus preferably provided with fasteners for releasably securing the nozzle extensions. Such fasteners may comprise, for instance, external threads 194 provided about the circumference of each of the nozzle extensions, which are adapted to matingly engage with internal threads 196 provided along the lengths of the main nozzles. The fasteners may also assume other suitable constructions such as the latch pin and slot arrangement discussed above.

The gas flow characteristics that may be selectively adjusted by the nozzle extensions include velocity and direction. Each nozzle extension 192 is preferably constructed such that a barrel portion 198 thereof is inclined with respect to its fastener portion, for example the threads 194. The inclination may be substantially linear, as illustrated, to define an angle Θ with respect to the nozzle flow axis B of between about 5° to 30°. Alternatively, the inclination of the barrel portion 198 may be achieved by curving the barrel portion with respect to the attachment portion of the nozzle extension. To facilitate insertion and removal of the nozzle extensions, the exterior surface of the barrel portions 198 of the nozzle extensions 192 are preferably provided with wrench flats or the like.

For a slag splashing operation the lance assemblies may include one or more nozzle extensions 192 extending at different angles from the main and/or auxiliary nozzles, depending upon which portion of the vessel's refractory lining has deteriorated and requires slag deposit. Similar nozzle extension adjustments may be made to optimize the deskulling operation and oxygen refining (including post-combustion) used only under emergency conditions. It will be understood that differently configured sets of nozzle extensions may be provided for the main and auxiliary nozzles. Likewise, in a particular set of nozzle extensions, certain nozzle extensions may assume different configurations and inclinations from other nozzle extensions in the same set.

Furthermore, the cross-sectional configurations of the nozzle extensions 192 may be formed in such a way as to vary the velocity of gas discharged from the main or auxiliary nozzles. For example, constricting the outlet opening of the nozzle extension relative to the outlet of the nozzle to which it is attached increases the gas discharge velocity.

Figure 17:
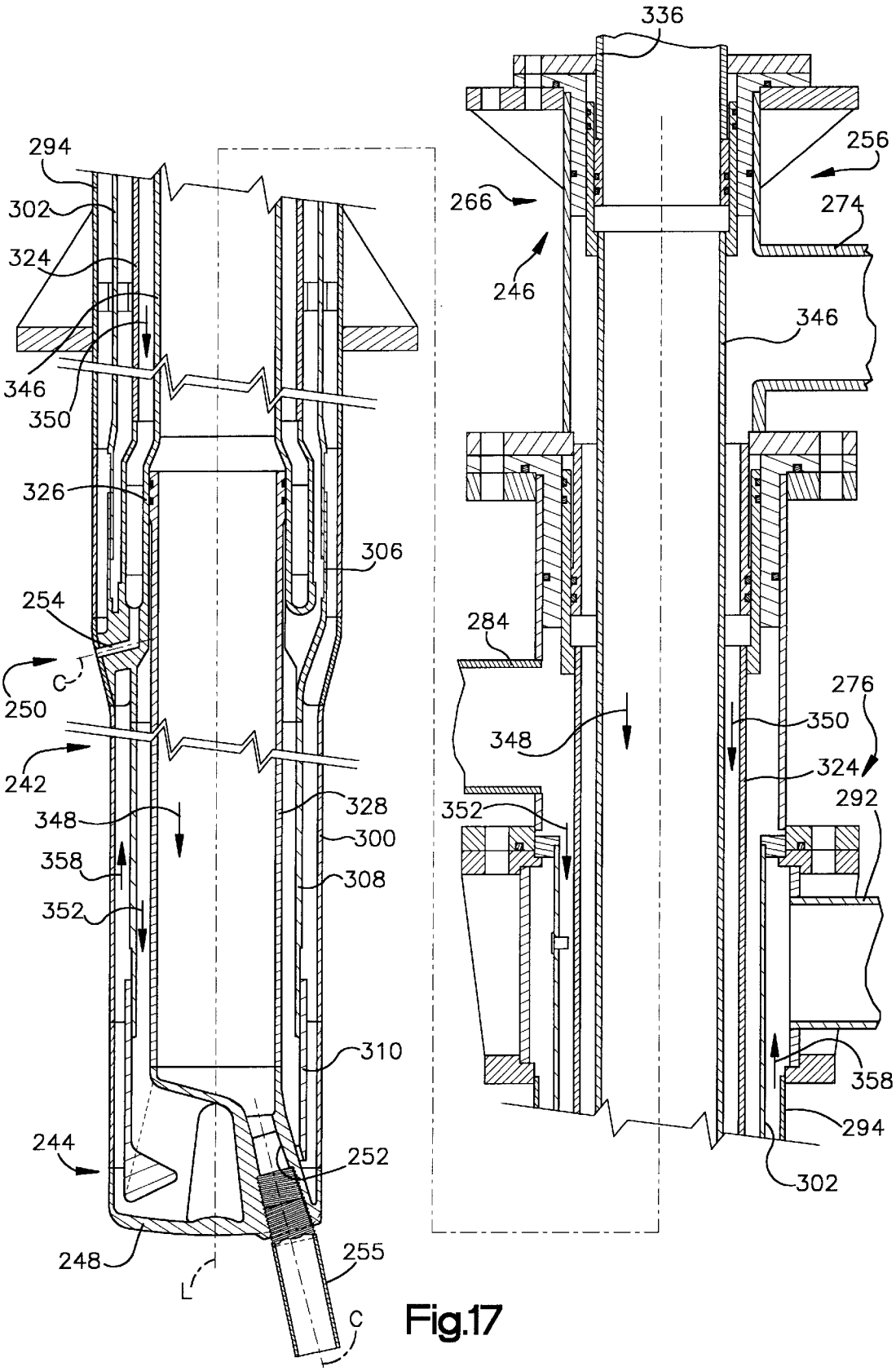
FIG. 17 is a vertical cross-sectional view of a third embodiment of the lance of the present invention in the form of a double circuit lance.

FIG. 17 is directed to a preferred third embodiment of the lance of the present invention, in the form of a double circuit lance assembly shown generally at 242. The lance 242 includes a lower end portion 244 and an upper end portion 246. A tip 248 is disposed at the lower end portion 244 and a distributor member 250 is disposed at a location spaced upwardly from the lower end portion 244 in the longitudinal direction L. Main nozzles 252 are located in the tip 248. Auxiliary nozzles 254 are spaced upwardly from the lower end portion 244 in the distributor section 250. The main nozzles and the auxiliary nozzles each extend along an associated axis C with respect to the longitudinal axis L of the lance.

A housing 256 is disposed at the upper end portion of the lance and may have any structure known to those skilled in the art. The housing 256 has an upper end portion 266 and a lower end portion 276. An auxiliary gas inlet pipe 274 is connected to an opening in the upper end of the housing 256. A coolant supply pipe 284 and a coolant return pipe 292 are each connected to an associated opening in the lower end of the housing 256.

An upper radially outermost pipe 294 is welded to the lower end of the housing 256. The lower end of the outer pipe 294 is welded to the distributor section 250.

The auxiliary nozzles 254 (only one of which is shown) are preferably circumferentially equally spaced around the longitudinal axis L of the lance 242. The auxiliary nozzles 254 diverge radially outward from the axis L.

A lower radially outermost pipe 300 is welded at its upper end to the distributor member 250. The lower end of the pipe 300 is welded to the tip 248.

Spaced inwardly of and concentric with the upper radially outermost pipe 294 is an upper pipe 302 welded at its upper end to the housing 256 and at its lower end engages a sleeve 306 that is welded to the distributor member 250. A lower pipe 308 is spaced inwardly of and concentric to the lower pipe 300. The upper end of the pipe 308 is connected to the sleeve 306. The lower end of the pipe 308 engages a sleeve 310 that is welded to the tip 248.

An upper pipe 324 is spaced inwardly of and concentric to the pipe 302. At its upper end, the pipe 324 is welded to the housing 256. The lower end of the pipe 324 is welded to the distributor member 250. An upwardly extending sleeve 326 is welded to the distributor member 250. Interior of and concentric to the lower pipe 308 is a lower pipe 328. The upper end of the pipe 328 engages the sleeve 326. The lower end of the pipe 328 is welded to the tip.

A main gas inlet pipe 336 is welded to the upper end portion of the housing 256. The main gas inlet pipe 336 is connected to the gas source via the lines 24 and 26. A radially innermost pipe 346 extends from the upper end of the lance to the distributor member. At its upper end, the pipe 346 is welded to the upper end of the housing 256 in fluid communication with the main gas inlet pipe 336. At its lower end, the pipe 346 is connected to the sleeve 326.

A main gas flow passageway 348, an auxiliary gas flow passageway 350, a lance coolant intake passageway 352 and a lance coolant outlet passageway 358 are defined by the pipes of the lance as will be apparent to those skilled in the art in view of this disclosure. Gas travels through the lance from the gas source via the lines 24, 26 to a diverter valve or the control valve array 138, which delivers the oxygen-containing gas and the inert gas to the main gas inlet pipe 336 and the auxiliary gas inlet pipe 274. The gas then travels from the main gas inlet pipe 336 through the passageway 348 to the nozzles 255 and from the auxiliary gas inlet pipe 374 through the passageway 350 to the auxiliary nozzles.

A coolant such as water is introduced from the coolant source, to the coolant supply line, through the lance coolant intake passageway 352, into the tip 248, through the lance coolant outlet passageway 358, to the coolant return line and back to the coolant source.

The following provides exemplary design information of the lances of the present invention. The refining lance and the auxiliary lance may be any suitable length. For example, each of the lances is approximately 78 feet in length. The lances are constructed of steel. The auxiliary nozzles are spaced a particular distance upwardly from the bottom of the lance, preferably in a range of from about 2 to 10 feet, and even more preferably, in the range of from about 6 to 8 feet. The pipes of the lance may range from 6 to 14 inches in diameter, for example. The main and auxiliary nozzles may be any diameter. For example, the auxiliary nozzles may be about ½ inch in diameter and the main nozzles may be about 2 inches in diameter.

The main nozzle angles preferably extend from the longitudinal axis in the range of from about 5° to about 20°. The following describes ranges of angles $\alpha$ at which gas flow through the main nozzles may be adjusted using the nozzle extensions in any embodiment of the invention.

When slag splashing to recondition the refractory walls at the lower end portion of the furnace, the main nozzle angles $\alpha$ are preferably adjusted to be in a range of from about 10° to about 20° with respect to the longitudinal axis of the lance. Blowing gas at this wide angle throws the slag outwardly and deposits slag on the refractory walls at the lower furnace end portion.

For slag splashing to recondition the refractory walls at the cone of the furnace, the main nozzle angles $\alpha$ are preferably adjusted to be in a range of from about 8° to about 15° with respect to the longitudinal axis of the lance. Nozzles extending at these angles transport the slag in the air quicker and thus permit the slag to reach the cone of the furnace for reconditioning the refractory walls there.

For slag splashing to recondition the refractory walls at the trunnion portion of the furnace, the main nozzle angles $\alpha$ are adjusted to an angle preferably within the range of from about 10° to about 14° with respect to the longitudinal axis of the lance.

For the deskulling operation, each of the auxiliary nozzles preferably extends at an angle $\beta$ in a range of from about 60° to about 75° with respect to the longitudinal axis of the lance. Nozzle angles exceeding 60° are preferred, with a nozzle angle of about 75° being more preferable.

For both the single and double circuit lance designs, any number of main nozzles may be used, although four or five main nozzles are preferred. Any number of auxiliary nozzles in the distributor section may be used, although 8 to 14 auxiliary nozzles are preferred.

As a general overview of the operation of the lances of the preferred second and third embodiments, the primary refining lance 16 is pivoted into an operative position and lowered into the furnace in the blowing position. At this point, the furnace has been charged with a bath of materials including steel scrap and molten iron. Refining of the molten metal then begins as high pressure, high purity oxygen is blown from the refining lance into the melt. Fluxes are charged into the furnace to form a slag layer. After the molten metal has been refined to steel using the refining lance 16, the lance is retracted vertically from the furnace and pivoted into the stand-by position. The steel is then sampled and tapped from the furnace.

The auxiliary lance of the invention is then pivoted from the standby position into the operative position above the furnace. The lance is then lowered into a blowing position in the furnace for conducting the slag splashing operation. The slag splashing operation is preferably conducted at the end of every heat and will be described in more detail hereafter. After slag splashing, the auxiliary lance is then retracted vertically from the furnace and pivoted to the standby position, and any slag remaining at the bottom of the furnace is removed through the slag taphole. The slag splashing may be conducted with or without the melt in the furnace. The furnace is then charged again and the refining lance 16 is then pivoted back into the operative position for another heat.

The deskulling operation is preferably conducted about once a day before or after tapping the melt from the furnace. It is preferable to deskull before tapping the furnace. In the deskulling operation the single circuit auxiliary lance is raised to insert the plugs into the main nozzles. The refining lance 16 is pivoted to the standby position and the auxiliary lance is pivoted to the operative position. The single circuit auxiliary lance having the plugs inserted is then lowered into the furnace into a blowing position. Oxygen gas is blown through only the auxiliary nozzles to impinge upon and melt the skull. In the case of the double circuit lance of the invention, an inert gas is blown from the main nozzles to prevent them from being clogged. The deskulling operation will be described in more detail hereafter. After the deskulling operation, the auxiliary lance is raised and pivoted to the standby position and the conventional refining lance is pivoted back to the operative position. The plugs may then be removed to prepare the lance of the present invention for the slag splashing operation.

Figure 13:
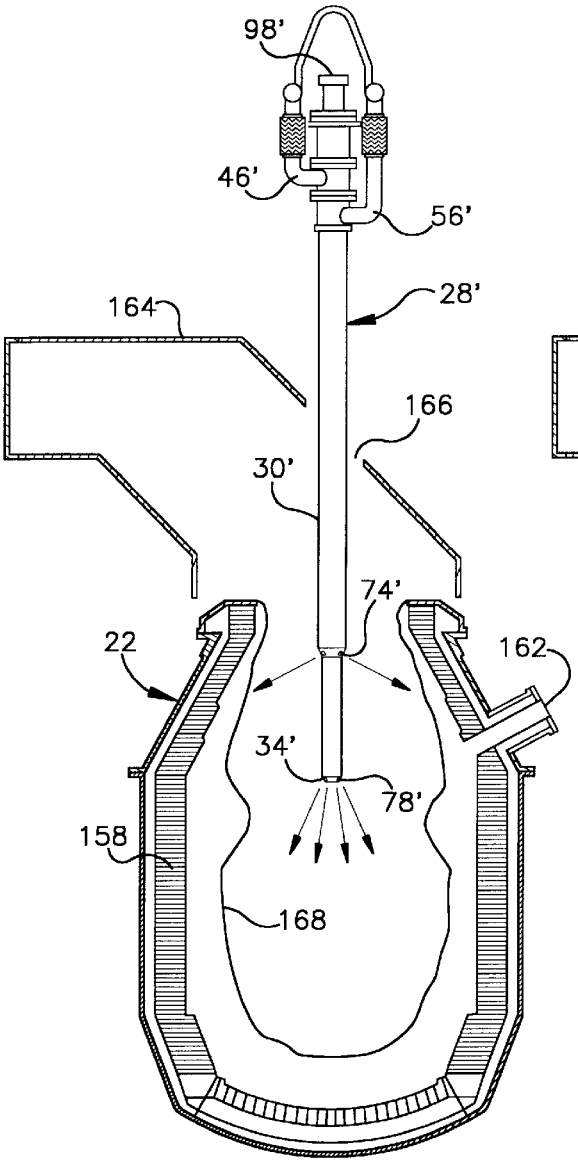
FIG. 13 is a view depicting the lance of the second embodiment during slag splashing.

The specifics of the slag splashing operation will now be discussed by reference to FIG. 13. In preparation for slag splashing, under normal conditions after a conventional refining lance has been moved into the standby position and, preferably after the steel has been tapped from the furnace, the slag left in the bottom of the furnace is preferably conditioned to have a basicity ratio known as a "V" ratio (i.e., a ratio of the concentration of CaO to the concentration of $SiO_2$) of greater than 2. It is preferred to use a V ratio of about 3.4. Additional MgO is also charged into the slag, preferably in the form of dolomitic lime, in excess of the MgO saturation, which is typically at 7.0% of the total slag volume. This serves to provide the slag with the right consistency and the proper tackiness that enable aggregate refractory MgO particles in the slag to be splashed up on the sides of the refractory walls to adhere to and thus recondition the walls.

After the molten metal bath has been tapped from the vessel 22, the lance 28' is reinserted into the vessel as shown (with the main nozzles being unplugged). At this time, the diverter valve is regulated such that only nitrogen gas is delivered to the gas inlet pipe 98'. As such, only nitrogen gas is discharged from both the main and auxiliary nozzles. When the slag splashing is operation is complete, the diverter valve is operated to cease all gas flow through the lance 28' and the lance is withdrawn from the vessel 22.

In the slag splashing operation using the double circuit lance assembly 242 of the third preferred embodiment, diverter valves are operated to direct nitrogen gas to the main gas inlet pipe where it travels down the main gas flow passageway and through the main nozzles. The diverter valves are also operated to direct nitrogen gas to the auxiliary gas inlet pipe where it travels down the auxiliary gas flow passageway and through the auxiliary nozzles.

In the case of both the single and double circuit designs, the nitrogen gas from the nozzles contacts the slag remaining in the furnace, preferably after the steel has been tapped. However, slag splashing may be conducted with or without the melt present in the furnace. The nitrogen gas from the main nozzles is primarily what effects splashing of the slag. During slag splashing in the case of both the single and double circuit lances, nitrogen gas passing through the auxiliary nozzles prevents them from becoming clogged with skull. The slag splashing operation throws the slag onto the deteriorated portions of the refractory walls and cools the slag close to its freezing point. Once the slag is cooled it adheres to the walls. When the refractory walls near the cone have deteriorated, it may be desirable to slag splash with the melt present in the furnace, to make it easier to throw the slag to the upper portions of the refractory walls. The slag splashing operation typically lasts between two and four minutes.

The following provides exemplary parameters regarding gas velocity, volume and pressure for slag splashing using both the single and double circuit designs. Nitrogen gas is blown at supersonic speeds of about Mach 1 to Mach 2. Nitrogen gas is blown from the main and auxiliary nozzle at a pressure in the range of from about 140 to 220 pounds per square inch gauge pressure ("psig"). The flow rate of inert gas through the main and auxiliary nozzles during slag splashing ranges from about 17,000 to 35,000 standard cubic feet/minute ("SCFM").

Slag splashing has proven to be quite effective in preventing furnace down time. In the past when no slag splashing was used, the number of heats that could be conducted without the need to replace the refractory walls ranged from about 3,000 to 8,000 heats. By performing slag splashing using a lance constructed in accordance with the second and third embodiments of the present invention, about 18,000 to 22,000 heats have already been conducted in one basic oxygen furnace without replacing the refractory walls.

Figure 14:
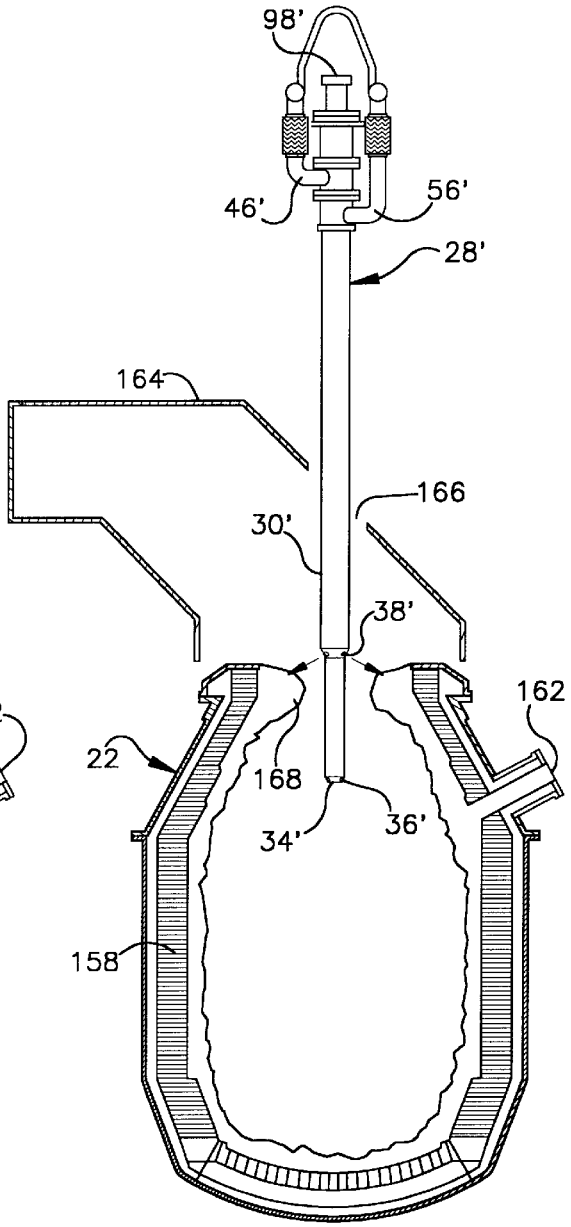
FIG. 14 is a view depicting the lance of the second embodiment during deskulling.

The specifics of the deskulling operation using the single circuit lance 28' will now be described by reference to FIG. 14. To prepare the lance assembly 28' for a deskulling procedure, all gas flow to the lance is stopped. The tip of the lance is raised above the vessel hood 164 and then pivoted or otherwise moved into a position where a worker may access the main nozzles and insert the removable plugs therein.

Once all of the main nozzles have been plugged, the lance is again brought into an operating position with respect to the vessel 22 and then inserted into the vessel until its auxiliary nozzles are directed at the slag deposits 168 at the vessel mouth. The diverter valve is suitably opened to deliver oxygen to the gas inlet pipe 98'. Because of the presence of the plugs in the main nozzles, oxygen flowing through the common gas flow passageway 106' is only discharged from the auxiliary nozzles. The plugs thus prevent the furnace from being contacted with and eroded by oxygen gas from the main nozzles. The plugs also prevent the main nozzles from becoming clogged with skull, which would be the case if no gas were blown through unplugged main nozzles.

When deskulling with the double circuit lance assembly 242 of the third embodiment, the diverter valves are operated to direct oxygen gas to the auxiliary gas inlet where it travels down the auxiliary gas flow passageway and out the auxiliary nozzles. The diverter valves also direct nitrogen gas to the main gas inlet pipe where it travels down the main flow passageway and out the main nozzles of the lance. Blowing nitrogen gas through the main nozzles prevents them from becoming clogged with skull. The double circuit lance assembly 242 thus avoids having to plug the main nozzles during deskulling.

The auxiliary lance in the case of both the single and double circuit designs is then moved up and down which causes the high pressure oxygen to impinge upon and melt the skull from the cone. The deskulling operation typically lasts between three and six minutes.

The following information provides exemplary parameters regarding gas velocity, volume and pressure when deskulling with both the single and double circuit lance designs. Oxygen gas is preferably blown at a velocity in a range of Mach 1.9 to Mach 2.5. More preferably, oxygen gas is blown at a velocity of about Mach 2.2. The total flow rate of oxygen that is blown during deskulling through the main and auxiliary nozzles is in the range of 5,000 to 13,000 SCFM. Oxygen gas is blown at a pressure of about 200 psig. Nitrogen gas is blown at a pressure ranging from 165 to 200 psig.

Although the invention has been described in its preferred form with a certain degree of particularity, it will be understood that the present disclosure of the preferred embodiments has been made only by way of example and that various changes may be resorted to without departing from the true spirit and scope of the invention as hereafter claimed.

What is claimed is:

1. Lance apparatus for cleaning and maintaining a steelmaking furnace comprising:

an elongated lance body including at least one first nozzle opening proximal to an end that extends into the furnace and at least one other second nozzle opening spaced upwardly from said first nozzle opening, and structure defining first and second passageways extending through said body to said first nozzle opening and said second nozzle opening, respectively, said passageways being isolated from mutual fluid communication, wherein said lance body extends along a longitudinal axis and each said second nozzle opening extends along a gas flow path at an angle with respect to the longitudinal axis of greater than 60°, and gas supply means for selectively introducing different gases into said passageways, whereby said lance apparatus can be operated to emit either different gases or the same gas from said first and second nozzle openings at the same time, said gases, comprising inert and oxygen-containing gases.

2. The lance apparatus of claim 1 wherein said gas supply means comprises first valve means connected to an oxygen-containing gas source and to said first and second passageways, said first valve means being operable in one position to connect said oxygen gas source to both passageways and in another position to connect said oxygen gas source to a selected one of said passageways, and second valve means connected to a gas source comprising an inert gas, said second valve means being operable in one position to connect said inert gas source to both passageways and in another position to connect said inert gas source to a selected one of said passageways.

3. The lance apparatus of claim 1 wherein each said first nozzle opening extends along a gas flow path at an angle with respect to the longitudinal axis in the range of from about 5° to about 20°.

4. The lance apparatus of claim 1 wherein each said second nozzle opening extends along a gas flow path at an angle with respect to the longitudinal axis up to about 75°.

5. The lance apparatus of claim 1 wherein each said first nozzle opening extends along a gas flow path at an angle with respect to the longitudinal axis in the range of from about 8° to about 20° and each said second nozzle opening extends along a gas flow path at an angle with respect to the longitudinal axis up to about 75°.

6. Lance apparatus for cleaning and maintaining a steelmaking furnace comprising:

an elongated lance body including at least one first nozzle opening proximal to an end that extends into the furnace and at least one other second nozzle opening spaced upwardly from said first nozzle opening, and structure defining first and second passageways extending through said body to said first nozzle opening and said second nozzle opening, respectively, said passageways being isolated from mutual fluid communication, gas supply means for selectively introducing different gases into said passageways whereby said lance apparatus can be operated to emit either different gases or the same gas from said first and second nozzle openings at the same time, said gases comprising inert and oxygen-containing gases, and at least one nozzle extension insertable into at least one of said first nozzle opening and said second nozzle opening for directing the flow of gas from at least one of said first nozzle opening and said second nozzle opening at different angles.

7. Lance apparatus for cleaning and maintaining a steelmaking furnace comprising an elongated lance body including at least one first nozzle opening proximal to an end that extends into the furnace and at least one other second nozzle opening spaced upwardly from said first nozzle opening, and structure defining a single passageway extending through said body to said first nozzle opening and to said second nozzle opening, wherein said lance body extends along a longitudinal axis and each said second nozzle opening extends along a gas flow path at an angle with respect to the longitudinal axis of greater than 60°, and gas supply means for selectively introducing different gases into said passageway, whereby said lance apparatus can be operated to emit either an oxygen-containing gas or a gas comprising an inert gas from said first and second nozzle openings at the same time.

8. The lance apparatus of claim 7 wherein each said first nozzle opening extends along a gas flow path at an angle with respect to the longitudinal axis in the range of from about 5° to about 20°.

9. The lance apparatus of claim 7 wherein each said second nozzle opening extends along a gas flow path at an angle with respect to the longitudinal axis of up to about 75°.

10. The lance apparatus of claim 7 wherein each said first nozzle opening extends along a gas flow path at an angle with respect to the longitudinal axis in the range of from about 8° to about 20° and each said second nozzle opening extends along a gas flow path at an angle with respect to the longitudinal axis of up to about 75°.

11. Lance apparatus for cleaning and maintaining a steelmaking furnace comprising an elongated lance body including at least one first nozzle opening proximal to an end that extends into the furnace and at least one other second nozzle opening spaced upwardly from said first nozzle opening, and structure defining a single passageway extending through said body to said first nozzle opening and to said second nozzle opening, gas supply means for selectively introducing different gases into said passageway, whereby said lance apparatus can be operated to emit either an oxygen-containing gas or a gas comprising an inert as from said first and second nozzle openings at the same time, and at least one nozzle extension insertable into at least one of said first nozzle opening and said second nozzle opening for directing the flow of gas from at least one of said first nozzle opening and said second nozzle opening at different angles.

12. A lance apparatus for cleaning and maintaining a steelmaking furnace comprising:

an elongated lance body comprising a barrel and a tip portion disposed at a lower end of said barrel that extends into the furnace, at least one first nozzle opening disposed in said tip portion and at least one other second nozzle opening disposed in said barrel at a location spaced upwardly from said first nozzle opening, and structure defining at least one passageway extending through said body to said first nozzle opening and said second nozzle opening, wherein said lance body extends along a longitudinal axis and each said second nozzle opening extends along a gas flow path at an angle with respect to the longitudinal axis of greater than 60°, and gas supply means for selectively introducing different gases into said passageway, whereby said lance apparatus can be operated to emit either different gases or the same gas from said first and second nozzle openings at the same time, said gases comprising inert and oxygen-containing gases.

13. A lance apparatus for cleaning and maintaining a steelmaking furnace comprising:

an elongated lance body comprising a barrel and a tip portion disposed at a lower end of said barrel that extends into the furnace at least one first nozzle opening disposed in said tip portion and at least one other second nozzle opening disposed in said barrel at a location spaced upwardly from said first nozzle opening, and structure defining at least one passageway extending through said body to said first nozzle opening and said second nozzle opening, gas supply means for selectively introducing different gases into said passageway, whereby said lance apparatus can be operated to emit either different gases or the same gas from said first and second nozzle openings at the same time, said gases comprising inert and oxygen-containing gases, and at least one plug member adapted to prevent the flow of gas through said first nozzle opening.

14. The lance apparatus of claim 13 wherein a portion of each said first nozzle opening is defined by an interior threaded surface and each said plug member has an exterior threaded surface for engaging said interior threaded surface.

15. A lance apparatus for cleaning and maintaining a steelmaking furnace comprising:

an elongated lance body comprising a barrel and a tip portion disposed at a lower end of said barrel that extends into the furnace, at least one first nozzle opening disposed in said tip portion and at least one other second nozzle opening disposed in said barrel at a location spaced upwardly from said first nozzle opening, and structure defining at least one passageway extending through said body to said first nozzle opening and said second nozzle opening, gas supply means for selectively introducing different gases into said passageway, whereby said lance apparatus can be operated to emit either different gases or the same gas from said first and second nozzle openings at the same time, said gases comprising inert and oxygen-containing gases, and at least one nozzle extension insertable into at least one of said first nozzle opening and said second nozzle opening for directing the flow of gas from at least one of said first nozzle opening and said second nozzle opening at different angles.

16. The lance apparatus of claim 15 wherein a portion of each said first nozzle opening is defined by an interior threaded surface, and each said nozzle extension has an exterior threaded surface for engaging said interior threaded surface.

17. A method of operating a lance in a steelmaking furnace comprising the steps of:

a) moving the lance into the furnace, wherein a body of the lance extends along a longitudinal axis, b) blowing a gas comprising an inert gas from the lance in a direction forming an angle of from about 5° to about 20° with respect to said longitudinal axis, and c) blowing an oxygen-containing gas from the lance in a direction forming an angle of greater than 60° with respect to said longitudinal axis.

18. A method of operating a lance in a steelmaking furnace comprising the steps of:

a) moving the lance into the furnace, wherein a body of the lance extends along a longitudinal axis, b) blowing a gas comprising an inert gas from the lance in a direction forming an angle of from about 5° to about 20° with respect to the longitudinal axis, and c) blowing an oxygen-containing gas from the lance in a direction forming an angle of greater than 60° with respect to the longitudinal axis, wherein step b) is carried out by blowing from a lower end portion of the lance and step c) is carried out by blowing from a portion of the lance spaced above said lower end portion.

19. A method of operating a lance in a steelmaking furnace comprising the steps of:

a) moving the lance into the furnace, b) blowing an inert gas from the lance, c) contacting slag in the furnace with said inert gas so as to deposit said slag onto a wall of the furnace, d) blowing an oxygen-containing gas from the lance toward skull deposits on the furnace wall, and e) removing said skull deposits from the furnace wall.

20. A method of cleaning and maintaining a basic oxygen furnace using the same lance comprising the steps of:

a) moving a lance into the furnace until the end of the lance is positioned a desired distance from the bottom of the furnace, wherein a body of the lance extends along a longitudinal axis, b) blowing an inert gas onto slag so as to deposit said slag onto a wall of the furnace, the blowing step being carried out by discharging the inert gas from the lance along a flow path which forms an angle from about 5° to about 20° with respect to the longitudinal axis, and c) deskulling the furnace by blowing an oxygen-containing gas onto skull deposits on the furnace wall, the deskulling step being carried out by discharging the oxygen-containing gas from the lance along a flow path which forms an angle of greater than 60° with respect to the longitudinal axis.

21. The method of claim 20 wherein the inert gas is discharged from a lower end portion of the lance and the oxygen-containing gas is discharged from a portion of the lance spaced above said lower end portion.

22. A method of cleaning a basic oxygen furnace comprising the steps of:

a) moving a lance into the furnace until the end of the lance is positioned a desired distance from the bottom of the furnace, wherein a body of the lance extends along a longitudinal axis, b) blowing an inert gas from a lower end portion of said lance, and c) deskulling the furnace by blowing an oxygen-containing gas onto skull deposits on a wall of the furnace, the deskulling step being carried out by discharging the oxygen-containing gas from the lance along a flow path which forms an angle of greater than 60° with respect to the longitudinal axis.

23. A method of cleaning a basic oxygen furnace comprising the steps of:

a) moving a lance into the furnace until the end of the lance is positioned a desired distance from the bottom of the furnace, wherein a body of the lance extends along a longitudinal axis, b) inserting plug members into nozzle openings at a lower end portion of said lance, and c) deskulling the furnace by blowing an oxygen-containing gas onto skull deposits on a wall of the furnace, the deskulling step being carried out by discharging the oxygen-containing gas from the lance along a flow path which forms an angle of greater than 60° with respect to said longitudinal axis.

24. A method of maintaining a basic oxygen furnace comprising the steps of:

a) moving a lance along an axis of travel into the furnace until the end of the lance is positioned a desired distance from the bottom of the furnace, b) blowing an inert gas onto slag so as to deposit said slag onto a wall of the furnace, the blowing step being carried out by discharging the inert gas from a lower end portion of the lance along a flow path which forms an angle from about 5° to about 20° with respect to said axis of travel, and c) blowing an inert gas from said lance at a location spaced above said lower end portion.

25. The method of claim 24 wherein the inert gas is blown from the lower end portion of the lance along adjustable flow paths.

26. The method of claim 25 wherein said inert gas is blown at the lower end portion of the lance at ranges of angles selected from the group consisting of: a) about 10° to about 20°, b) about 8° to about 15° and c) about 10° to about 14°.

27. A lance assembly communicable with at least one supply of gas, said lance assembly comprising:

a housing;

a barrel having a central axis, a first end attached to said housing and a second end carrying a tip, said barrel including at least one main nozzle, at least one auxiliary nozzle, and at least one gas flow passage in communication with said main nozzle and said auxiliary nozzle, wherein each said auxiliary nozzle extends along a gas flow path at an angle with respect to the central axis of greater than 60°; and selective discharge means for enabling an oxygen-containing gas and an inert gas to be selectively discharged from at least one of said main nozzle and said auxiliary nozzle.

28. The lance assembly of claim 27 wherein the at least one said gas flow passage comprises a main gas flow passage in communication with said main nozzle and an auxiliary gas flow passage in communication with said auxiliary nozzle, said main gas flow passage being isolated from fluid communication with said auxiliary gas flow passage.

29. The lance assembly of claim 28 wherein said selective discharge means comprises a first inlet communicable with a first gas supply, a second inlet communicable with a second gas supply, a first outlet operatively connected to said main gas flow passage, a second outlet operatively connected to said auxiliary gas flow passage, and valve means for selectively communicating said first and second inlets with said first and second outlets.

30. A lance assembly communicable with at least one supply of gas, said lance assembly comprising:

a housing;

a barrel having a central axis, a first end attached to said housing and a second end carrying a tip, said barrel including at least one main nozzle, at least one auxiliary nozzle, and at least one gas flow passage in communication with said main nozzle and said auxiliary nozzle;

selective discharge means for enabling an oxygen-containing gas and an inert gas to be selectively discharged from at least one of said main nozzle and said auxiliary nozzle, wherein the at least one said gas flow passage comprises a main gas flow passage in communication with said main nozzle and an auxiliary gas flow passage in communication with said auxiliary nozzle, said main gas flow passage being isolated from fluid communication with said auxiliary gas flow passage;

wherein said selective discharge means comprises a first inlet communicable with a first gas supply, a second inlet communicable with a second gas supply, a first outlet operatively connected to said main gas flow passage, a second outlet operatively connected to said auxiliary gas flow passage, and valve means for selectively communicating said first and second inlets with said first and second outlets; and wherein said valve means comprises an array of two-position valves including a first valve connected to said first inlet and said first outlet, a second valve connected to said first inlet and said second outlet, a third valve connected to said second inlet and said first outlet, and a fourth valve connected to said second inlet and said second outlet.

31. The lance assembly of claim 30 further comprising means for selectively opening and closing each of said first, second, third and fourth valves.

32. The lance assembly of claim 27 wherein said main nozzle and said auxiliary nozzle are disposed in said tip.

33. The lance assembly of claim 27 wherein said main nozzle is disposed in said tip and said auxiliary nozzle is disposed in said barrel at a location spaced upwardly from said tip.

34. The lance assembly of claim 27 wherein a single gas flow passage is in communication with both said main nozzle and said auxiliary nozzle.

35. The lance assembly of claim 27 wherein each said main nozzle diverges outwardly from the central axis at an angle in the range of from about 5° to about 20°.

36. A lance assembly communicable with at least one supply of gas, said lance assembly comprising:

a housing;

a barrel having a central axis, a first end attached to said housing and a second end carrying a tip, said barrel including at least one main nozzle, at least one auxiliary nozzle, and at least one gas flow passage in communication with said main nozzle and said auxiliary nozzle;

selective discharge means for enabling an oxygen-containing gas and an inert gas to be selectively discharged from at least one of said main nozzle and said auxiliary nozzle; and at least one tubular nozzle extension insertable into said main nozzle for adjusting the angle of gas flow through said main nozzle.

37. The lance assembly of claim 36 wherein gas flows through said main nozzle in a direction of a gas flow axis, and each said nozzle extension comprises a portion that is inclined with respect to said gas flow axis.

38. The lance assembly of claim 36 further comprising at least one fastener for releasably securing said nozzle extension in said main nozzles.

39. The lance assembly of claim 38 wherein each said fastener comprises mating threads carried by said nozzle extension and said main nozzle.

40. The lance assembly of claim 38 wherein each said fastener comprises:

at least one latch member carried by one of said nozzle extension and said main nozzle; and at least one recessed slot engageable with said latch member, said recessed slot being carried by the other of said nozzle extension and said main nozzle.

41. A lance assembly communicable with at least one supply of gas, said lance assembly comprising:

a housing;

a barrel having a central axis, a first end attached to said housing and a second end carrying a tip, said barrel including at least one main nozzle, at least one auxiliary nozzle, and at least one gas flow passage in communication with said main nozzle and said auxiliary nozzle;

selective discharge means for enabling an oxygen-containing gas and an inert gas to be selectively discharged from at least one of said main nozzle and said auxiliary nozzle; and at least one plug member insertable into said main nozzle for preventing gas flow through said main nozzle.

42. The lance assembly of claim 41 further comprising at least one fastener for releasably securing said plug member in said main nozzle.

43. The lance assembly of claim 42 wherein said fastener comprises mating threads carried by said plug member and said main nozzle.

44. The lance assembly of claim 42 wherein each said fastener comprises:

at least one latch member carried by one of said plug member and said main nozzle; and at least one recessed slot engageable with said latch member, said recessed slot being carried by the other of said plug member and said main nozzle.

* * * * *

UNITED STATES PATENT AND TRADEMARK OFFICE

CERTIFICATE OF CORRECTION

PATENT NO. : 5,865,876

DATED : February 2, 1999

INVENTOR(S) : Richard R. Watkins, Kenneth M. Goodson and Nicholas M. Rymarchyk, Jr.

It is certified that error appears in the above-indentified patent and that said Letters Patent is hereby corrected as shown below:

On the title page:

Item [73]; the Assignee should read:

"LTV Steel Company, Inc., NJ and Berry Metal Company, DE."

Signed and Sealed this

Twenty-sixth Day of October, 1999

*Attest:*

Q. TODD DICKINSON

*Attesting Officer*

*Acting Commissioner of Patents and Trademarks*